United States Patent [19]

Reed et al.

[11] Patent Number: 4,761,002

[45] Date of Patent: Aug. 2, 1988

[54] DOCUMENT HANDLING AND COUNTING APPARATUS

[75] Inventors: John M. Reed, Lebanon; William Sherman, III, Medford, both of N.J.; Peter J. Loftus, Levittown, Pa.

[73] Assignee: Brandt, Inc., Bensalem, Pa.

[21] Appl. No.: 820,981

[22] Filed: Jan. 21, 1986

[51] Int. Cl.[4] ..... B65H 7/12

[52] U.S. Cl. ..... 271/111; 271/259; 271/263; 271/265

[58] Field of Search ..... 271/110, 111, 258, 259, 271/263, 265

[56] References Cited

U.S. PATENT DOCUMENTS 4,471,954 9/1984 Bourg ..... 271/263 X 4,605,926 8/1986 Onishi ..... 271/263 X

*Primary Examiner*—Richard A. Schacher

*Attorney, Agent, or Firm*—Shenier & O'Connor

[57] ABSTRACT

Apparatus for counting and stacking sheets in which document length and multiple fed sheets are detected by examining sheet transmissivity. The light directed through moving sheets fed one at a time through a sensor location is modulated according to sheet transmissivity. The signal for each sheet is compared against the signal for the prior sheet to determine the feeding of multiple sheets. Sheet length is determined through the use of a pair of sensors which provide for counting of sheets which may be fed in a skewed manner. A skew value is used to modify the value obtained when measuring document length to permit accurate counting of both skewed and unskewed sheets. Both hardware and software techniques are utilized to obtain the desired results.

24 Claims, 17 Drawing Sheets

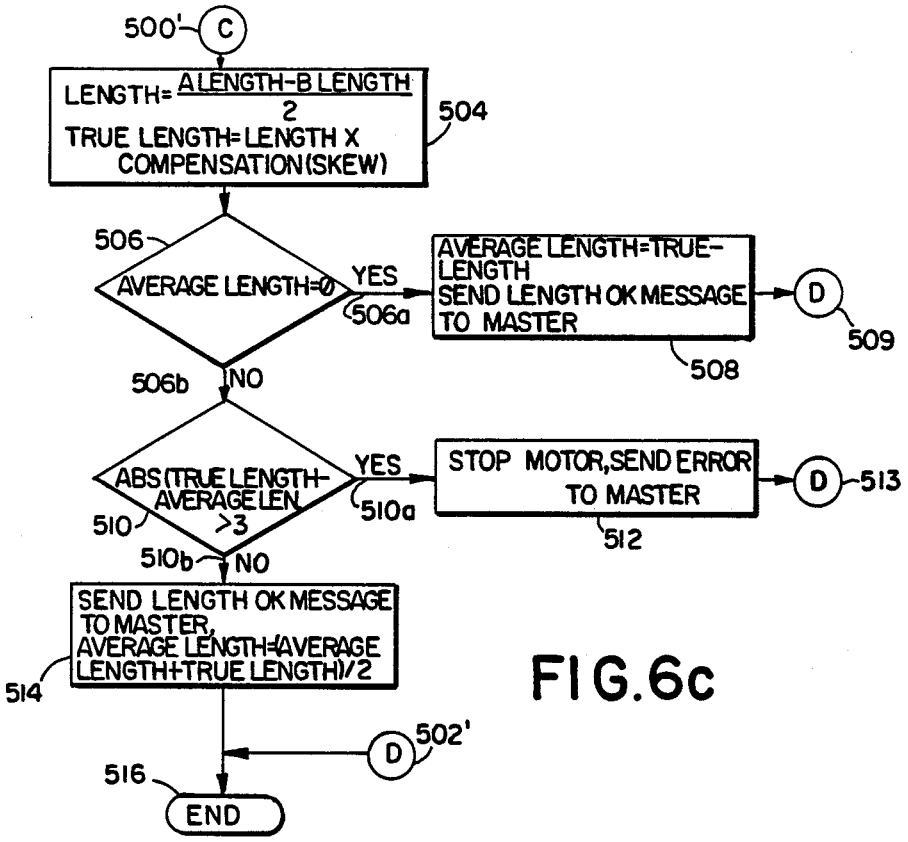

FIG.6c

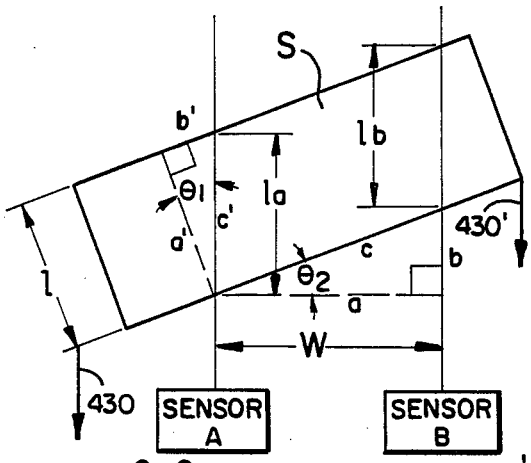

GIVEN: $\theta_1 = \theta_2$

1. $\therefore \frac{a'}{a} = \frac{b'}{b} = \frac{c'}{c}$ $\therefore$ l(true length)=a'

$\therefore$ W(sensor width)=a $\therefore$ la (A sensor's apparent length)=lb=c'

$\therefore a^2 + b^2 = c^2$

2 $\therefore a'^2 + b'^2 = c'^2$ from 1 $\frac{a'}{a} = \frac{c'}{c}$ $a' = a\frac{c'}{c}$ from 2 $a' = a\frac{c'}{\sqrt{a^2+b^2}}$ $a' = c'\frac{a}{\sqrt{a^2+b^2}}$ $f(b) = \frac{a}{\sqrt{a^2+b^2}}$ ; pre-evaluated for each value of "b"

$\therefore a' = c' f(b)$

FIG. 7a

USING A VALUE OF 52mm FOR a, AND EVALUATING THE EXPRESSION FOR EVERY 1.0mm VALUE AT b (SKEW) THE FOLLOWING TABLE WAS GENERATED

| b | $f(b)=\frac{a}{\sqrt{a^2+b^2}}$ |
|---|---|
| 0 | 1.00 |
| 1 | 1.00 |
| 2 | 1.00 |
| 3 | 1.00 |
| 4 | 1.00 |
| 5 | 1.00 |
| 6 | 0.99 |
| 7 | 0.99 |
| 8 | 0.99 |
| 9 | 0.99 |
| 10 | 0.98 |
| 11 | 0.98 |
| 12 | 0.97 |
| 13 | 0.97 |
| 14 | 0.97 |
| 15 | 0.96 |
| 16 | 0.96 |
| 17 | 0.95 |
| 18 | 0.94 |

DOCUMENT HANDLING AND COUNTING APPARATUS

FIELD OF THE INVENTION

The present invention relates to document handling and counting apparatus and more particularly to control means for measuring document length and transmittance to detect the presence of overlapping and/or multiple feed documents.

BACKGROUND OF THE INVENTION

Apparatus is presently available for handling counting and stacking sheets such as paper currency, checks, food stamps and the like. Such apparatus which is described for example in U.S. Pat. No. 4,474,365 issued Oct. 2 , 1984 and assigned to the assignee of the present application, discloses cooperating feed and stripper means for advancing sheets from an input tray one at a time for examination by sensing devices and for accelerating the examined sheets which are then delivered to an output tray. It is extremely desirable in the handling of such documents to be assured that the documents are in fact moved one at a time through the sensing region since the feeding of overlapping or multiple fed documents, as well as shorter than normal documents, has a negative effect upon the counting accuracy of the apparatus.

BRIEF DESCRIPTION OF THE INVENTION

The present invention provides improved control means for use in sheet handling and counting apparatus which is characterized by comprising sensing means for measuring the transmittance of sheets as they move through the sensing location. The transmittance signal is utilized to determine document length as well as transmittance and serves also to provide a counting function.

Sheets moving through the sensing location pass between a pair of light sources and cooperating sensors to generate signals which are a function of the light derived from the cooperating light source which is modulated in accordance with the transmittance of the passing sheet (or sheets). The transmittance signals are summed and their sums are integrated by integrating means which is triggered to operate upon the ocurrence of the leading edge of a sheet. The peak value of a first sheet is developed in a first storage means and is thereafter transferred to second storage means. The first storage means subsequently contains the peak value of the next examined sheet. These values are compared to provide a double feed indication when the absolute values of the difference between the two compared values lies outside of a predetermined threshold. This action is continuously repeated as long as sheets continue to be fed through the sensing location. The double feed indication is preferably utilized to halt the handling and counting opertion.

The handling and counting apparatus preferably employs either a high speed, precision stepper motor or a d.c. motor and a brake/clutch assembly which provides for rapid starting and stopping of the feed mechanism. The control apparatus incorporates a closed-loop motor braking technique which is accomplished through the use of software wherein the software program is initiated responsive to a halt signal. The motor is thereafter set to freewheel and the count generated by an encoder is read at two time intervals separated by a predetermined delay and these values are stored in memory. The difference between these values represents the new velocity. If the counts are equal, the motor is set to freewheel and the program is terminated. If the counts are not equal, and the new velocity is greater than the old velocity, the motor is set to freewheel and the program is terminated. If the new velocity is no greater than the old velocity, the motor is set to freewheel and the program is terminated. If the new velocity is greater than the old velocity, the motor is reversed, the new velocity becomes the old velocity and the new count becomes the old count and a new count is taken after the aforementioned delay interval whereupon the new velocity is recalculated and the new and old counts and new and old velocities are again reexamined to determine if the motor has been halted.

The software program controls an electrical circuit for selectively reversing the polarity of the drive signal to the motor for performing either braking or normal feeding operations. When employing a stepper motor, the motor speed is controlled by pulsing the motor, utilizing pulses of a variable repetition rate, which rate is a function of the desired operating speed. Alternatively, the pulses of a constant repetition rate but variable pulse width may be utilized to regulate motor speed.

Document length is determined through the use of a program which measures document length, taking into account the possible skewing of a document through the utilization of a pair of spaced apart sensors which determine the amount of skewing in accordance with the possible time differences that the leading edges of a document pass the sensors. The length of the portions of the sheet passing each sensor is also determined and the skew and length information are utilized to halt the feeding mechanism in the event that the sheet being examined is of non-uniform dimension along its length as well as determining the true length. The program utilizes a table look-up technique in which a factor for each stored skew value is utilized for determining true length. If the true length falls within certain parameters, the document is indicated as being a proper length. If the true length falls outside of these parameters, the feeding operation is halted and an error condition is provided. The technique described hereinabove assures the accurate counting of documents or, alternatively, abruptly halts sheet feeding in the event the multiple fed, torn or severely skewed documents are found to be passing through the feed mechanism.

OBJECTS OF THE INVENTION AND BRIEF DESCRIPTION OF THE FIGURES

It is therefore one object of the present invention to provide novel apparatus for determining the transmissivity and length of sheets passing a sensing location at high speed.

Still another object of the present invention is to provide novel apparatus for abruptly halting a sheet feeding mechanism by selectively switching the polarity of the voltage applied to the motor driving the feed mechanism.

Still another object of the present invention is to provide a novel device for determining the presence of multiple fed sheets passing a sensing location by comparing the transmissivity values of successively fed sheets.

Still another object of the present invention is to provide a novel method and apparatus for determining the length of sheets which takes into account skewing of the sheets being examined.

The above as well as other objects of the present invention will become apparent when reading the accompanying description and drawing in which:

FIG. 1 is a simplified side elevation of a document handling and counting apparatus for use with the control apparatus of the present invention.

FIGS. 1*a* and 1*b* are schematic diagrams which, when taken together, constitute apparatus for determining the presence of multiple fed sheets passing through document handling and counting apparatus.

FIG. 1*c* is a simplified block diagram of microprocessor control means for use with the apparatus of FIGS. 1*a* and 1*b*.

FIG. 1*d* is a schematic diagram of apparatus for performing the sheet detection technique of FIGS. 1a and 1b using a combined hardward/software technique.

Figure 3:
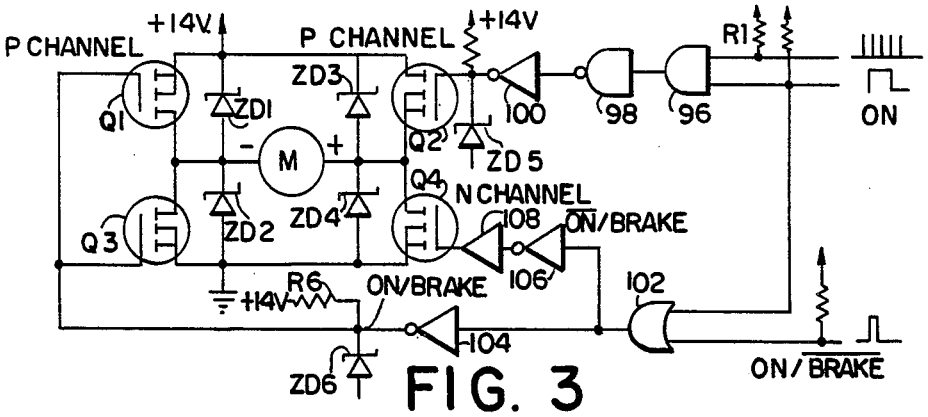
FIG. 3 is a circuit diagram of the motor control circuit.
Figure 3A:
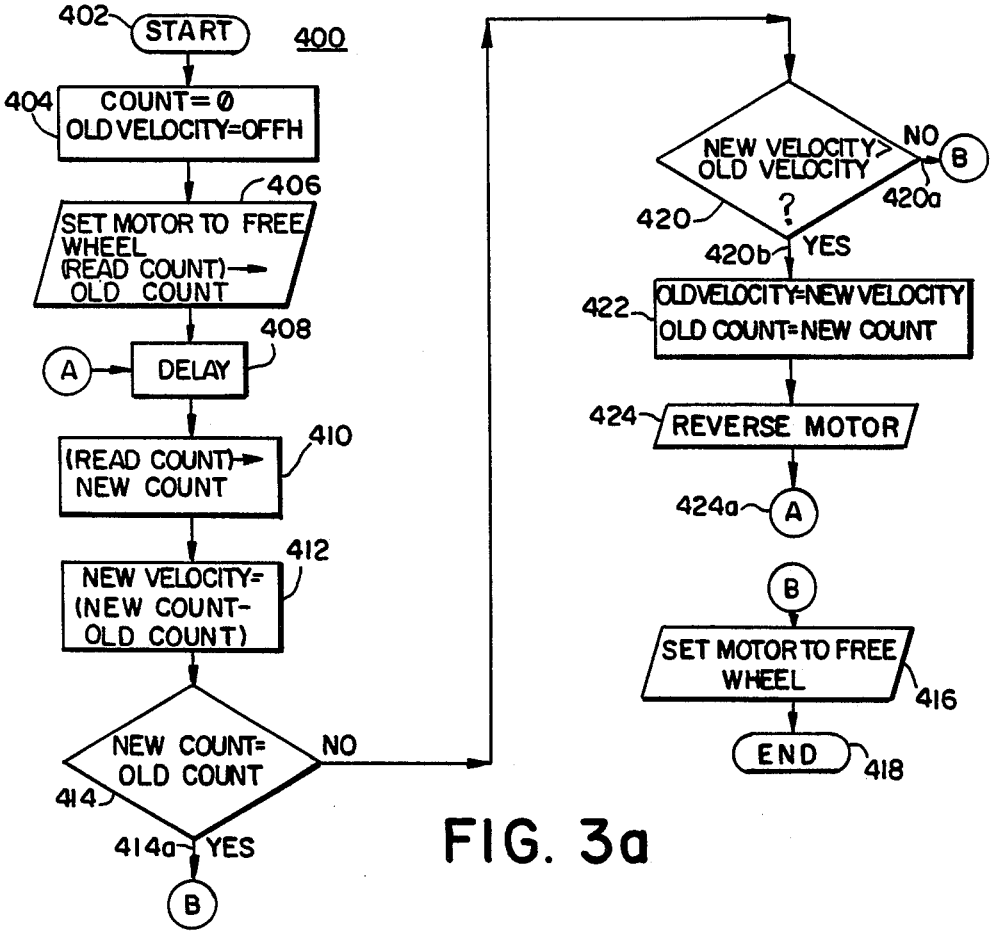

FIG. 3*a* is a flow diagram showing the braking technique employed for operating the motor control circuit of FIG. 3.

Figure 4:
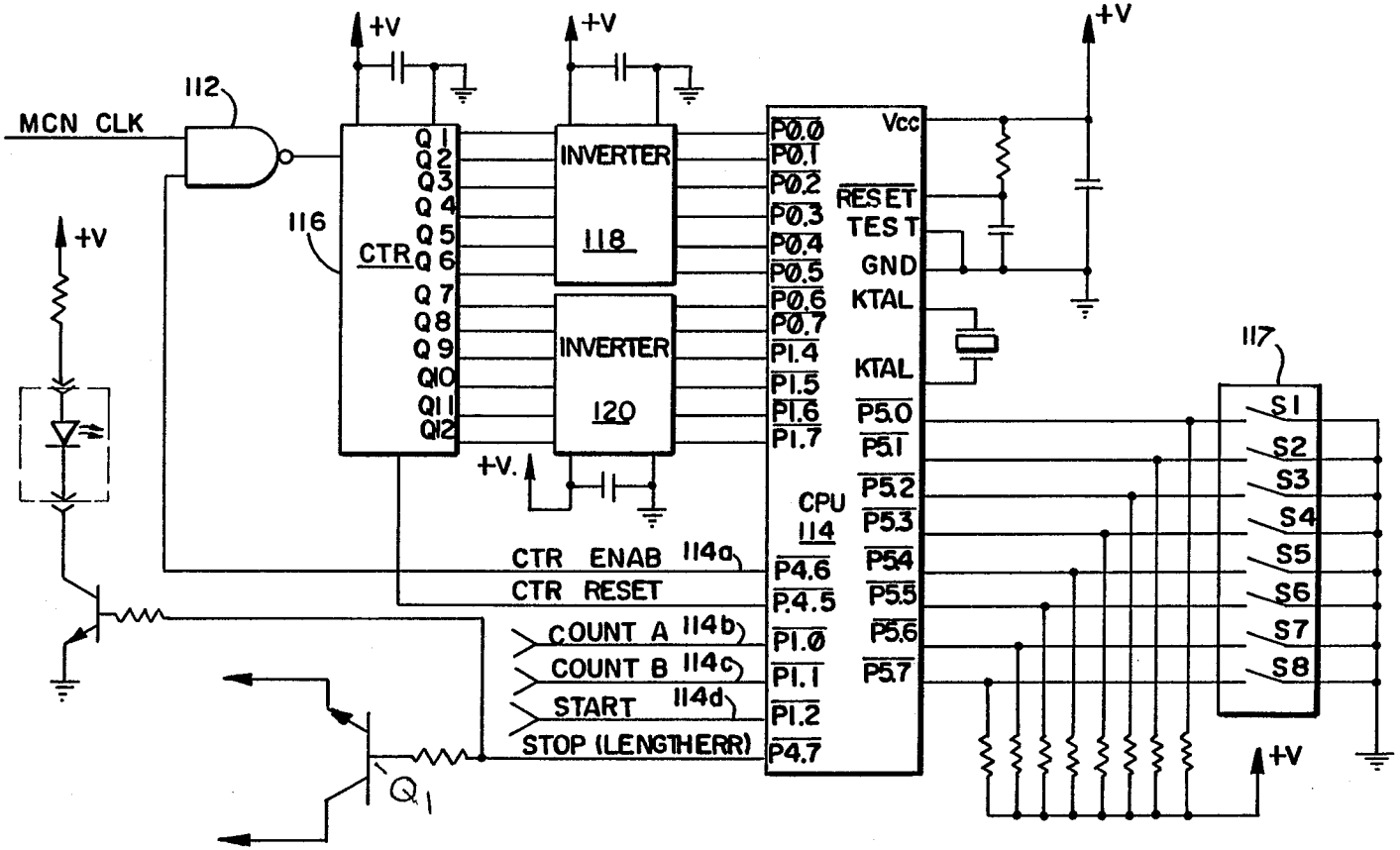

FIG. 4 is a block diagram showing the circuitry for performing self-adaptive length discrimination and/or doubles detection.

Figure 5A:
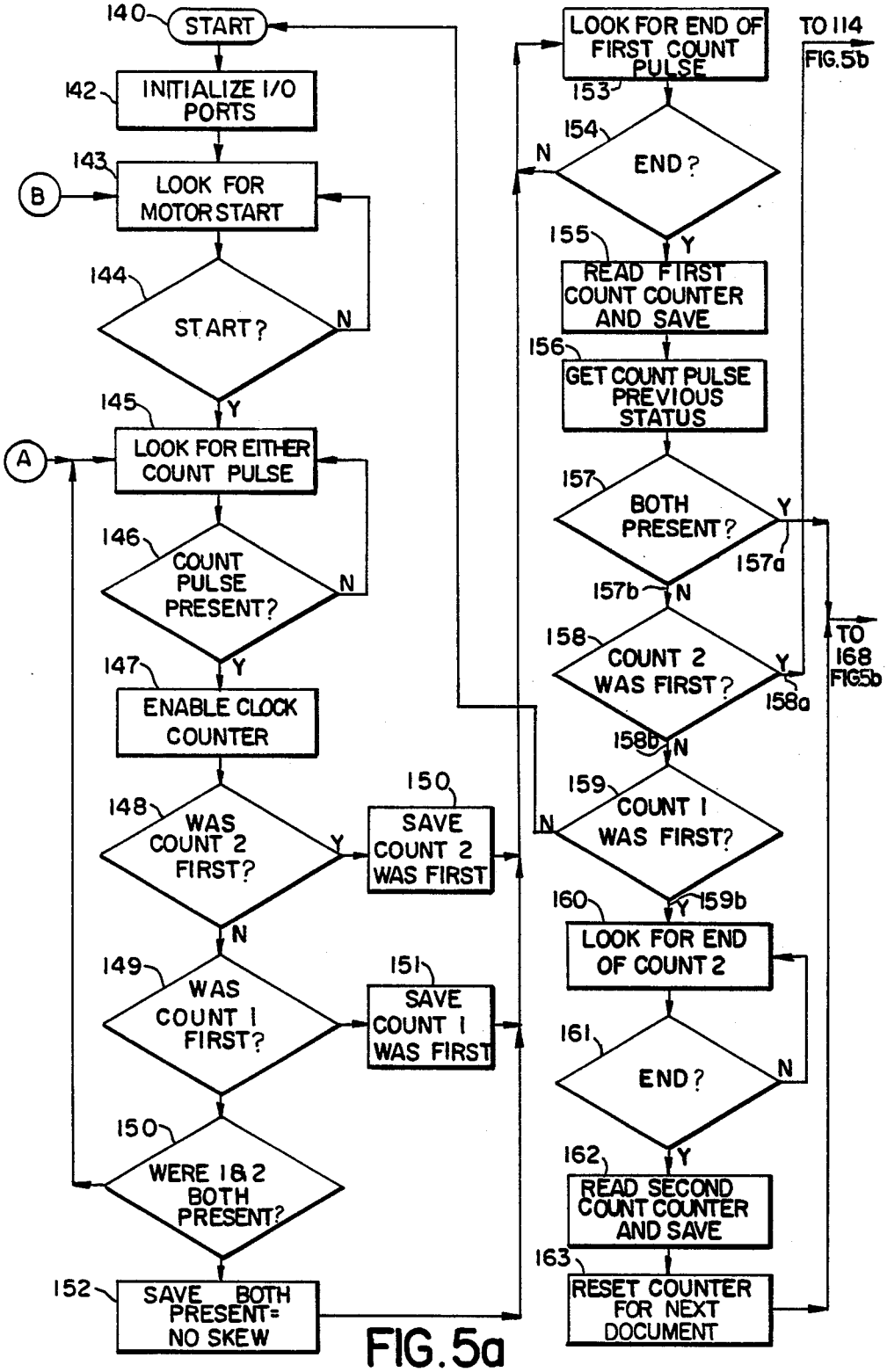
Figure 5B:
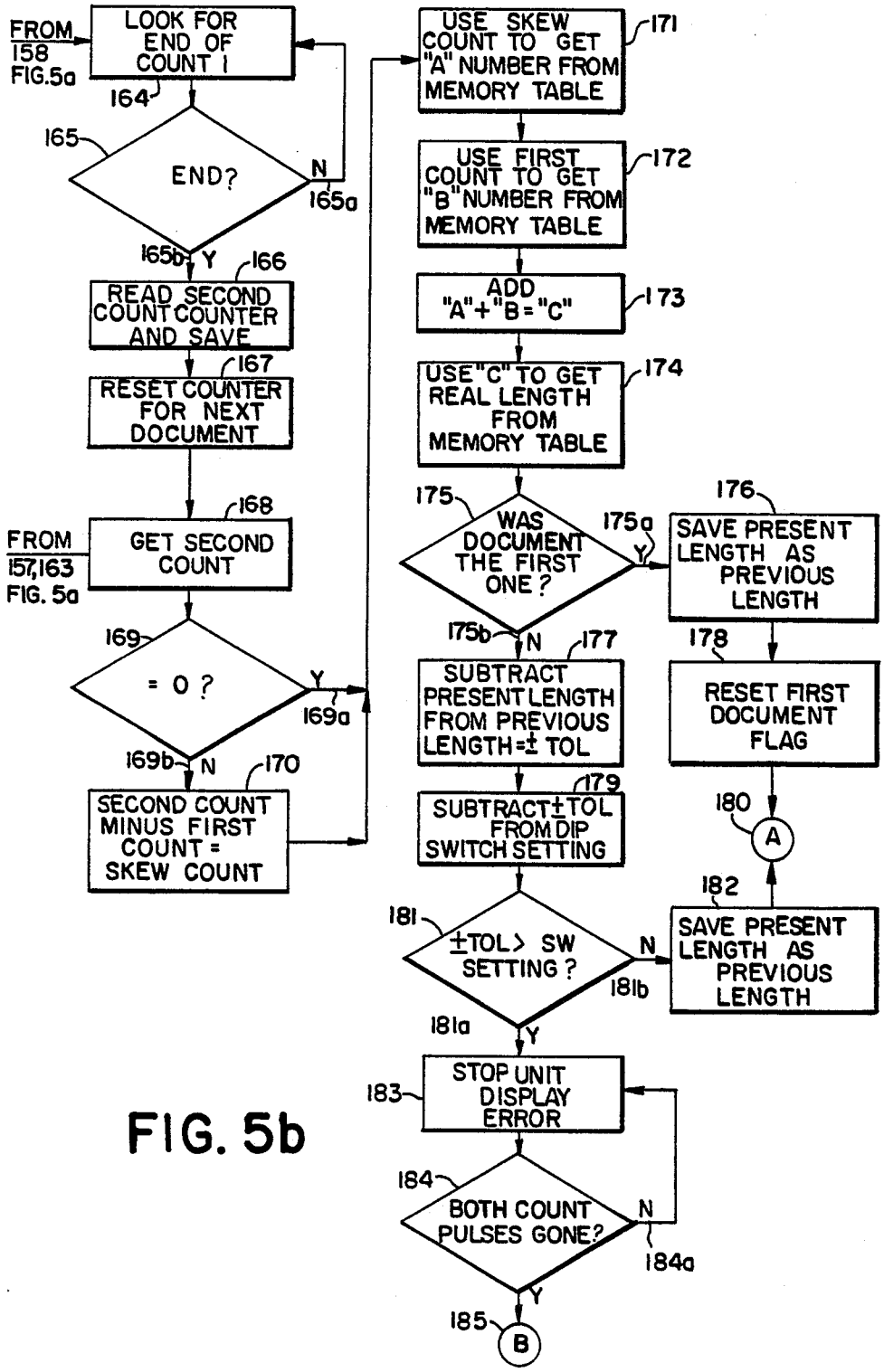

FIGS. 5*a* and 5*b* show the flow diagram utilized to select the compensation factors and thereby obtain the true length measurement.

Figure 6A:
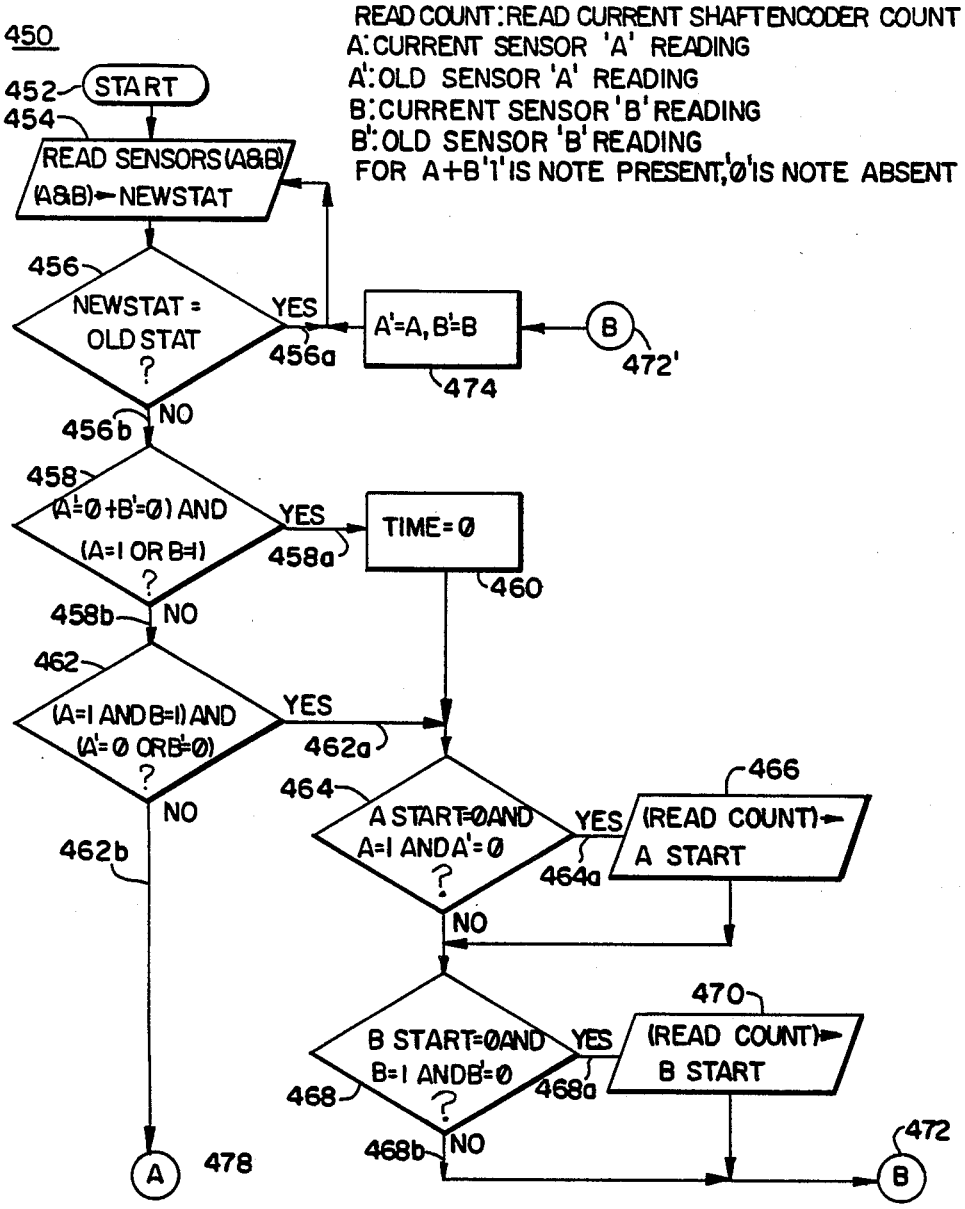
Figure 6B:
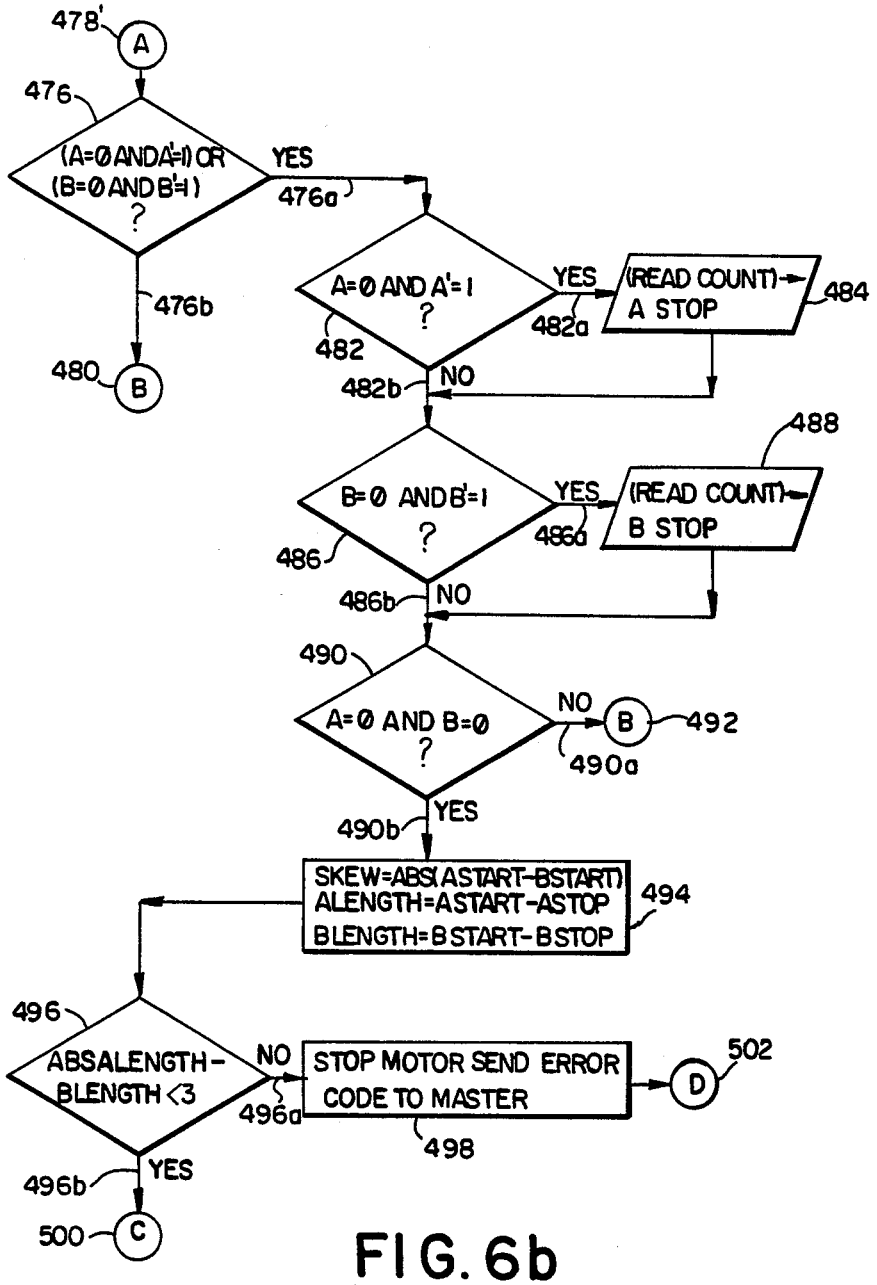

FIG. 7*a* shows a simplified diagram of a document which is useful for explaining the skew compensation technique employed in the determination of document length as shown in FIGS. 6*a*–6*c*.

Figures 7B, 7C:
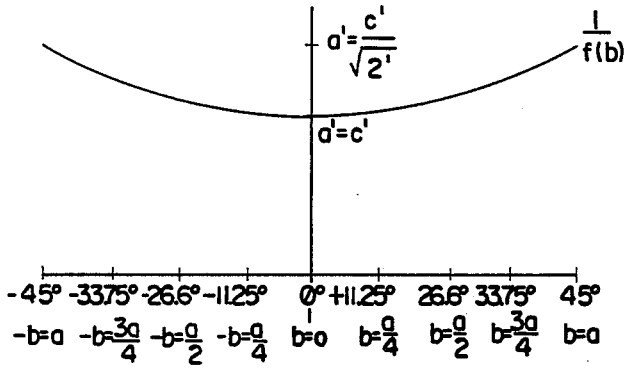

FIG. 7*b* shows a curve which represents the possible values of the compensation factor as a function of the skew angle.

FIG. 7*c* is a table showing the values of some of the compensation factors determined in accordance with the skew compensation technique.

FIGS. 6*a*–6*c* collectively shown the flow chart for performing a length measurement technique as shown in FIGS. 7*a*–7*c*.

Figure 8A:
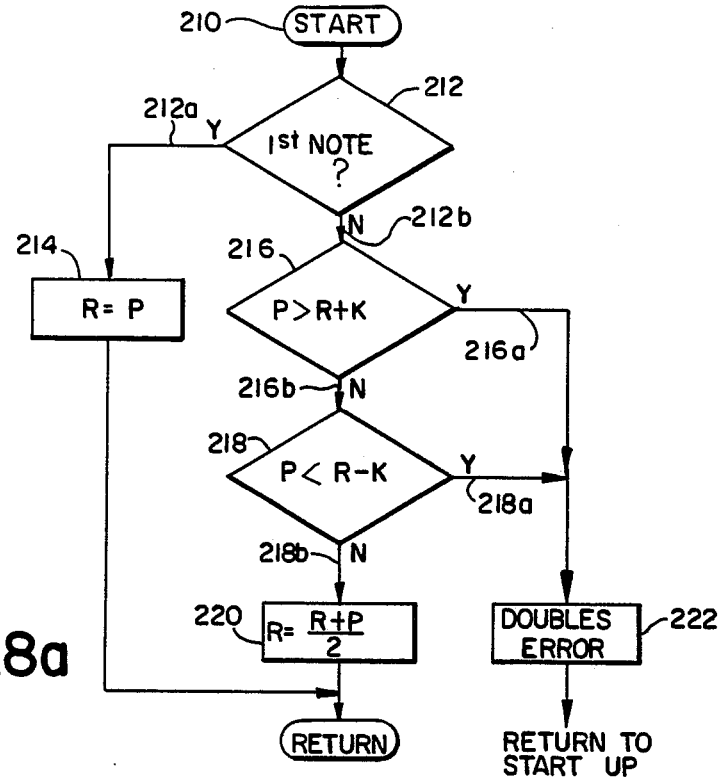
Figure 8B:
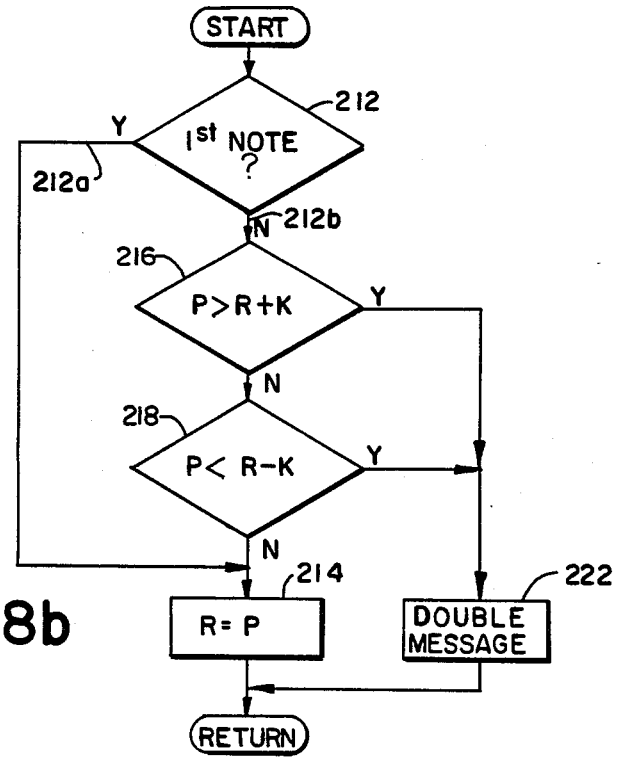

FIGS. 8*a* and 8*b* show flow diagrams of implementation of alternative measurement techniques.

Figure 9A:
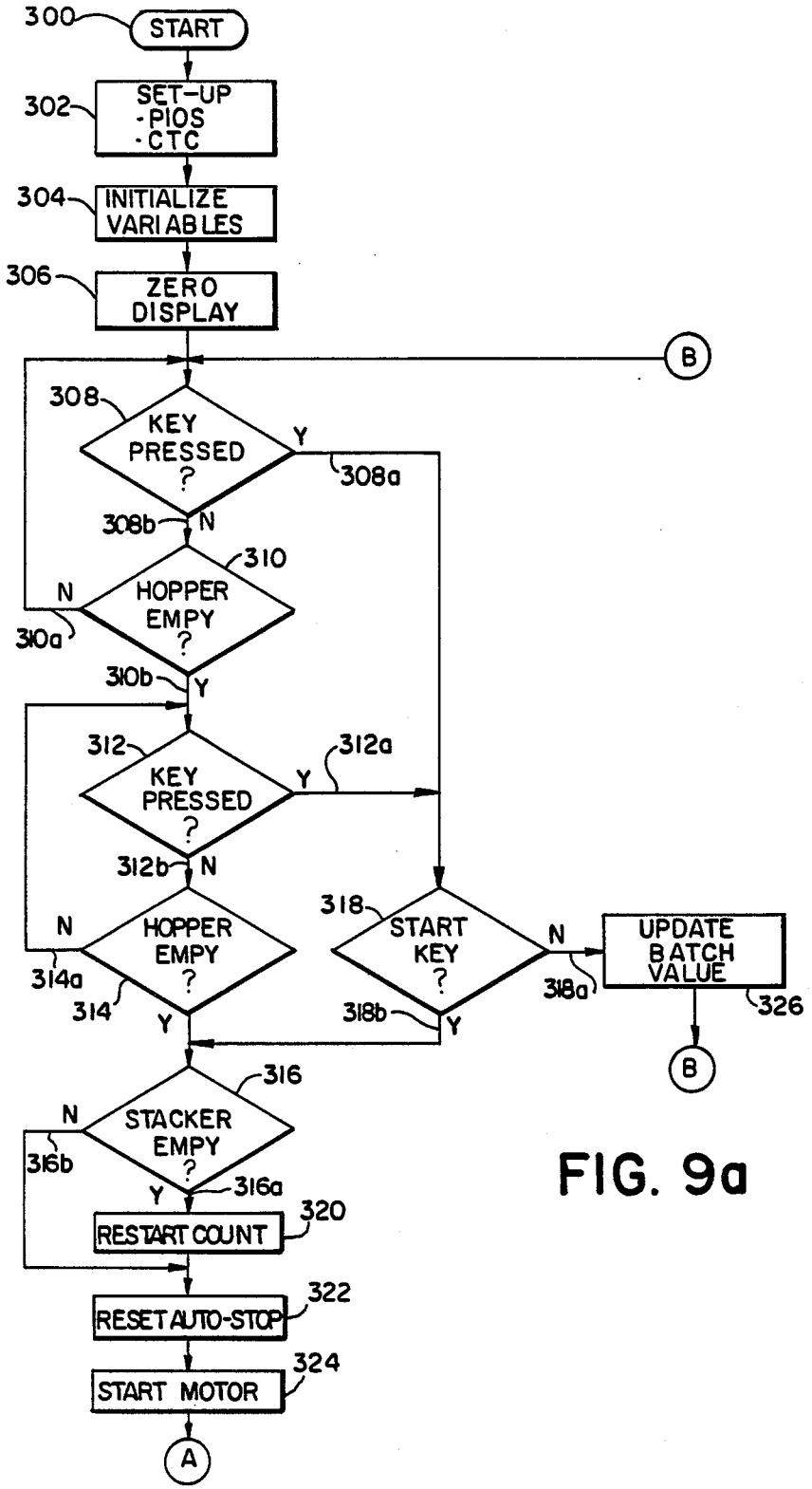
Figure 9B:
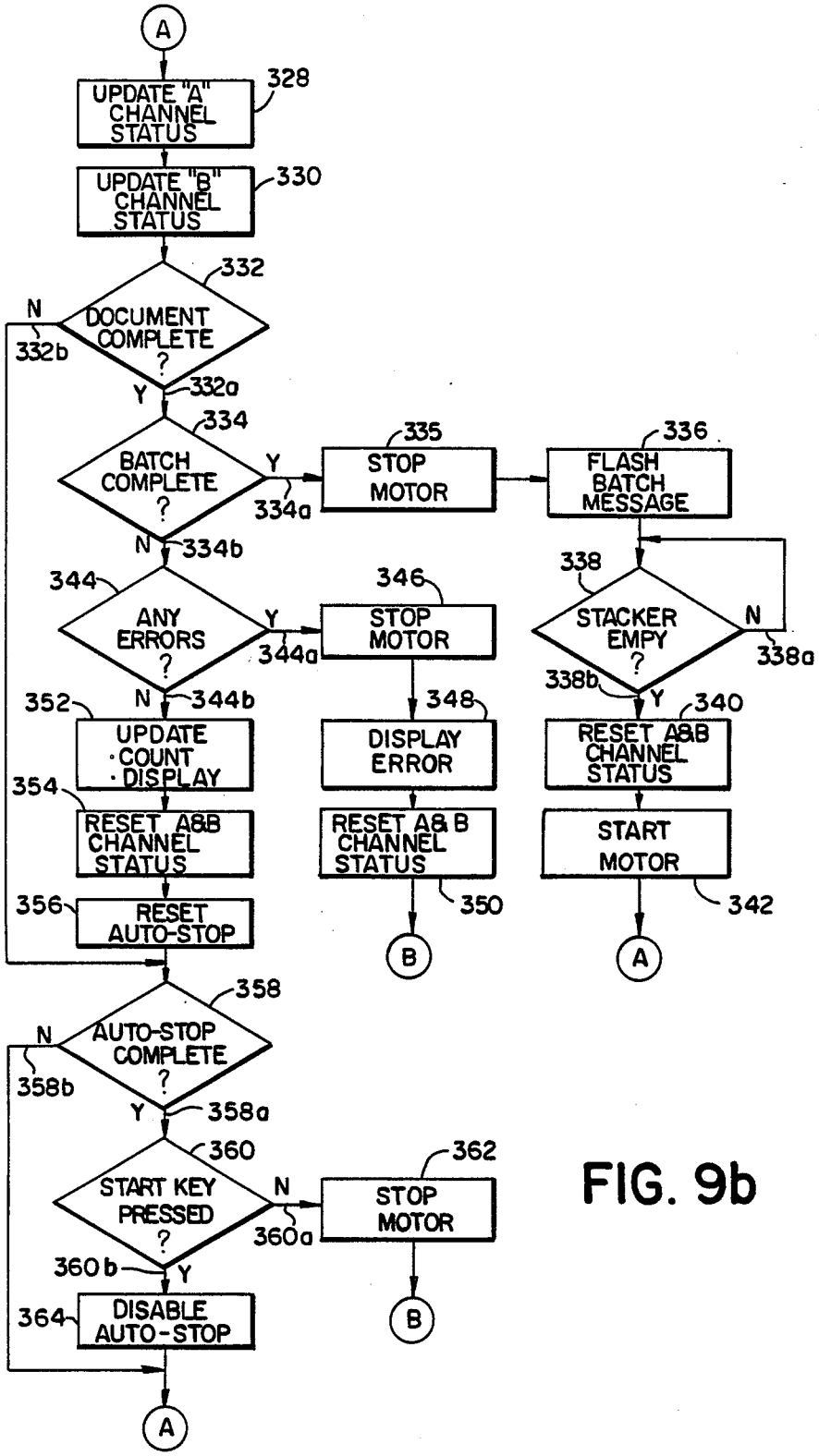

FIGS. 9*a* and 9*b* collectively comprise the flow chart for 7*a* and 7*b*.

DETAILED DESCRIPTION OF THE INVENTION AND PREFERRED EMBODIMENTS THEREOF

Figure 1:
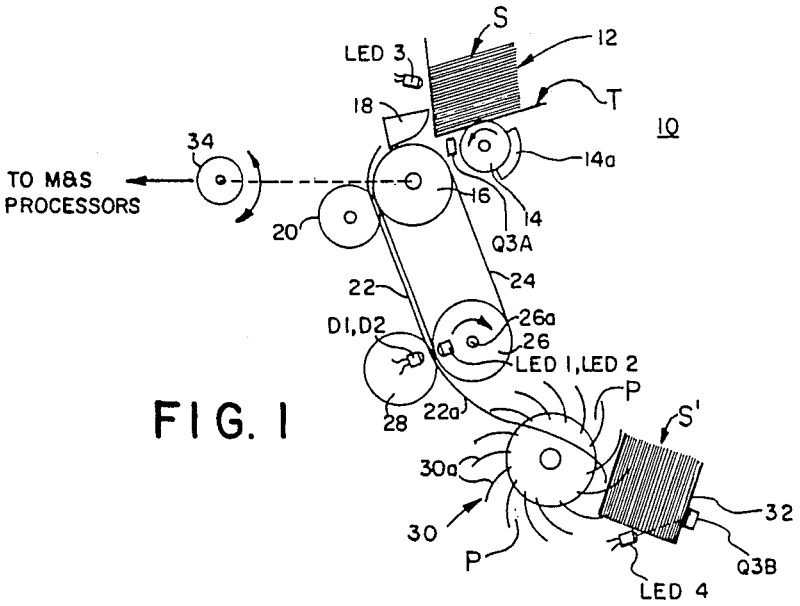

FIG. 1 shows a simplified view of a document handling and counting device 10 having an input tray receiving a stack S of sheets such as paper currency, food stamps, bank notes or any other sheets appropriate for handling or counting. A kicker wheel 14 having an eccentric portion 14*a* protrudes through the bottom of the tray to advance the bottom sheet toward a feed nip defined by a feed roller 16 and stripper shoe 18. The feed nip feeds documents one at a time in the forward feed direction between guideway 22 and O-rings 24. An idler 20 cooperates with the feed roller to advance sheets toward the acceleration roller 26 and cooperating idler 28. The O-rings 24 cooperate with guideway 22 to form the guide path along which sheets are moved between the feed nip and the acceleration nip formed between rollers 26 and 28. The acceleration nip accelerates each sheet to form a gap between adjacent sheets which is utilized for counting purposes. A pair of light sources LEDl and LED2 cooperate with a pair of photosensitive diodes Dl and D2 which sense the passage of sheets for counting, doubles detection and length measurement, as will be more fully described hereinbelow.

Accelerated sheets are advanced along guideway portion 22*a* where they enter into the pocket P formed between a pair of adjacent curved resilient blades 30*a* of stacker wheel 30. An output tray 32 strips sheets from stacker wheel 30 and accumulates the sheets to form a stack S' therein.

Light LED3 and sensor Q3A which may, for example, be a phototransistor, are utilized to detect the presence of sheets in the input tray. A similar light source LED4 and phototransistor Q3B are utilized to detect the presence of sheets in the output tray.

Figure 1A:
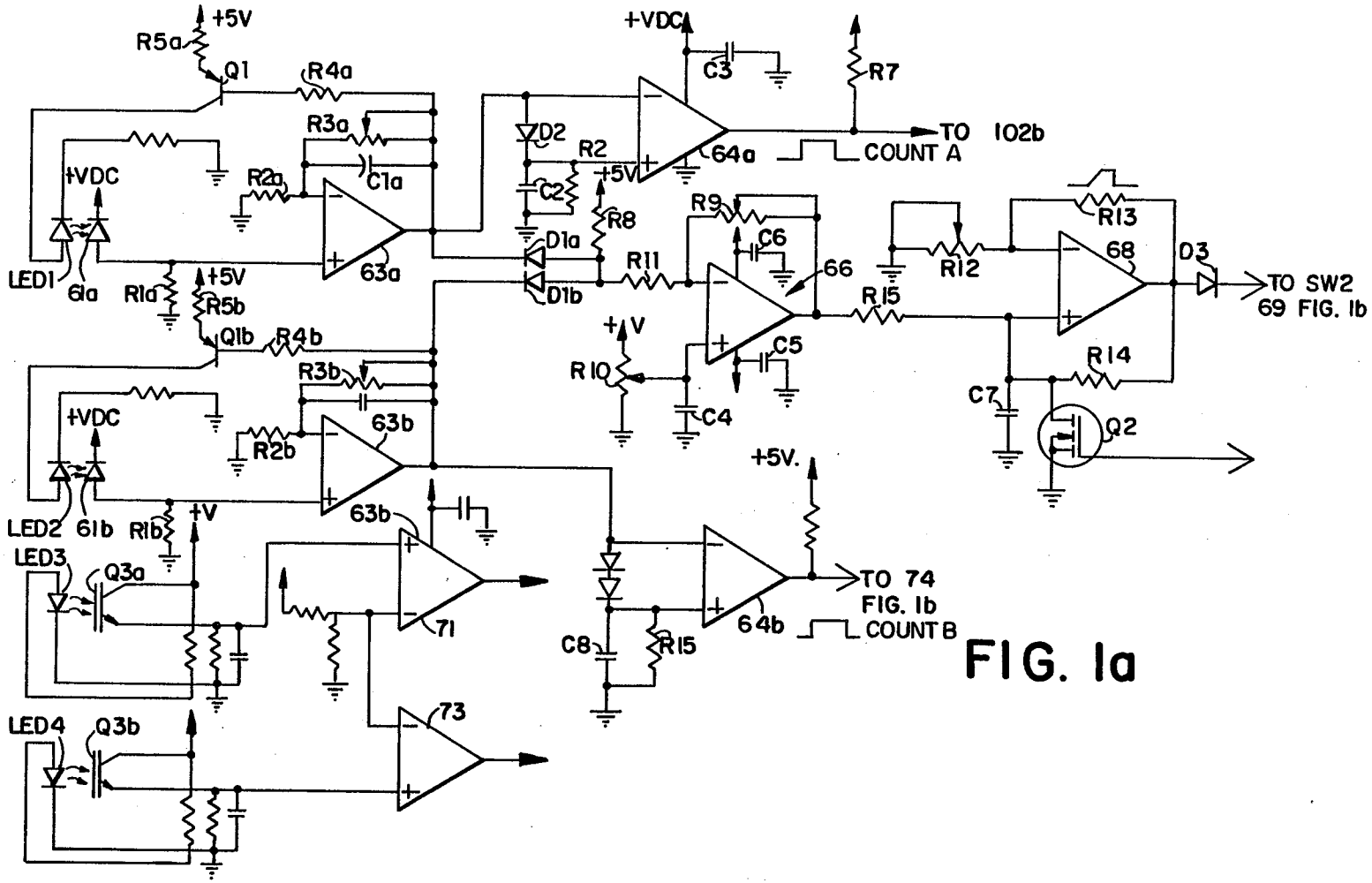
Figure 1B:
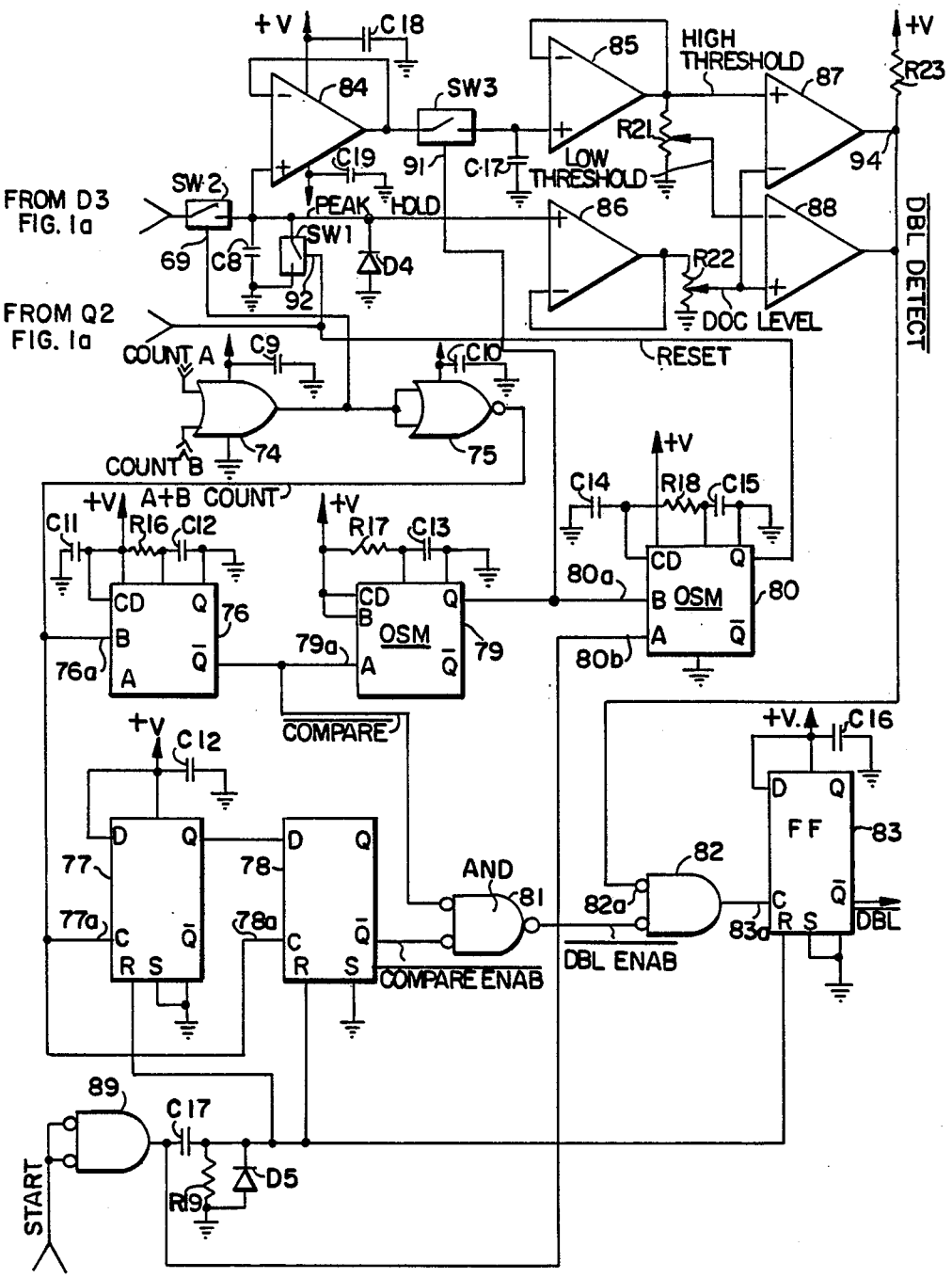

FIGS. 1*a* and 1*b* show one preferred embodiment for doubles detection in accordance with the principles of the present invention. FIG. 1*a* shows the sensors employed for counting and doubles detection as well as the sensors employed for monitoring the presence of sheets in the input and output trays (See FIG. 1).

The apparatus for counting and doubles detection utilizes first and second light sources LEDl and LED2 arranged on one side of a path along which sheets to be counted are moved. Light sensitive diodes 61*a* and 61*b* (Dl, D2) are arranged on the opposite side of said path. The intensity of light detected by sensors 61*a*, 61*b* is a function of the presence or absence of sheets moving through the feed path as well as a function of the transmissivity of the sheets. Operational amplifiers 63*a* and 63*b* amplify the modulated signal. A feedback path including transistors Qla and Qlb feed back the light signals delivered to LEDl and LED2, respectively, to maintain these output levels substantially constant. The gain of operational amplifiers 63*a* and 63*b* is adjustable by adjustment of potentiometers R3*a* and R3*b*, respectively.

The output of operational amplifier 63*a* is coupled in common to operational amplifier 64*a* and diode Dla. The output of operational amplifier 64*a* generates an output utilized for counting purposes, as will be more fully described.

Operational amplifier 63*b* has its output coupled in common to diode Dlb and operational amplifier 64*b* to develop a pulse at a Count B output which is likewise utilized for counting purposes.

The sum of the amplified outputs from sensors 61*a* and 61*b* are applied to the inverting input of operational amplifier 66 whose output is coupled to the non-inverting input of operational amplifier 68. A capacitor C7 is coupled between the non-inverting input and ground. Transistor (FET type) Q2 is coupled across capacitor C7. The output of operational amplifier 68 is coupled through diode D3 to one input of solid state switch SW2 (FIG. 1*b*) whose output is coupled to capacitor C8 when the control input 69 of solid state switch SW2 is energized.

The input tray of the handling and counting apparatus is provided with LED3 and a cooperating phototransistor Q3*a*. The output tray of the handling and counting apparatus is provided with LED4 and phototransistor Q3*b*. The signals developed by Q3*a* and Q3*b* are amplified by operational amplifiers 71 and 73 respectively and are utilized to monitor the input and output trays of the apparatus 10 for operations to be more fully described hereinbelow.

Considering FIG. 1*b*, the Count A and Count B pulses developed by operational amplifiers 64*a* and 64*b* are coupled to respective inputs of NOR gate 74. The output of NOR gate 74 is coupled to the control input 69 of solid state switch SW2 and is further connected to the trigger input 76*a* of one-shot multivibrator (OSM) 76 through NOR gate 75 which is wired to function as an inverter. The output of inverter 75 is further coupled to inputs 77*a* and 78*a* of bistable flip-flops (FF) 77 and 78 which are connected to function as a two stage counter.

The $\overline{Q}$ output of OSM 76 is coupled to input 79*a* of OSM 79. The $\overline{Q}$ output of OSM 79 is coupled to input 80*a* of OSM 80.

The $\overline{Q}$ output of OSM 76 is also coupled to one input of AND gate 81 whose other input is coupled to the $\overline{Q}$ output of flip-flop (FF) 78. The output of AND gate 81 is coupled to one input of AND gate 82 whose other input is coupled in common to the outputs of the doubles detection comparators 87, 88 respectively. The output of gate 82 is coupled to the clock input 83*a* of D-type flip-flop (FF) 83. Gate 89, which receives the START pulse, has its output coupled through capacitor C17*a* to the reset inputs R of FFs 77, 78 and 83 and is further coupled to input 80*b* of OSM 80 directly.

As was described hereinabove, the output of solid state switch SW2 is selectively coupled to capacitor C8 which develops a voltage thereacross which level is applied to the non-inverting inputs of operational amplifiers (OP) 84 and 86. The output of operational amplifier (OP) 84 is selectively coupled to the non-inverting input of operational amplifier (OP) 85 through solid state switch SW3. Capacitor C17 is coupled between the non-inverting input of operational amplifier 85 and ground potential.

The output of operational amplifier 85 is coupled to the non-inverting input of comparator 87 and a portion of the output of amplifier 85 is coupled to the inverting input of comparator 88, depending upon the adjustment of potentiometer R21. In a similar manner, potentiometer R22 couples a portion of the signal developed by operational amplifier 86 to the non-inverting input of comparator 88 and the inverting input of comparator 87.

Figure 2:
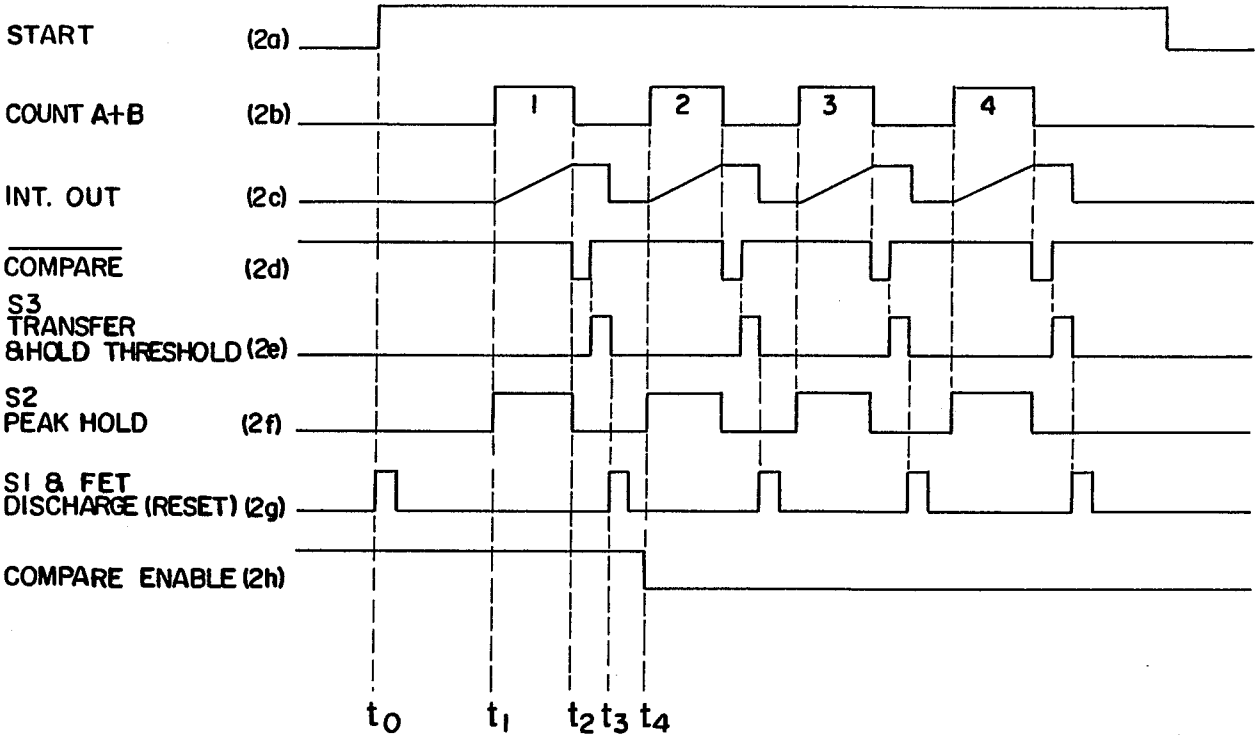
FIG. 2 shows a series of waveforms useful in describing the operation of the circuitry of FIGS. 1*a* and 1*b*.

The operation of the doubles detection circuit of FIGS. 1*a* and 1*b* is as follows (also making reference to FIG. 2):

When the equipment is turned on at $t_0$, a START signal 2*a* is applied to gate 89 which resets flip-flops 77, 78 and 83 and which further triggers OSM80 (2*g*) to develop a reset signal at its Q output at $t_0$. This signal is applied to the control input 92 of solid state switch SWl and to the control electrode of transistor Q2. Solid state switch SWl discharges capacitor C8 and transistor Q2 discharges capacitor C7 (2*h*).

When the leading edge of the next bill is sensed at $t_1$ by one or both of the sensors 61*a*, 61*b*, the output of gate 74 applies a control signal to control input 79 of solid state switch SW2, closing this switch during the time interval $t_1$-$t_2$ to apply the summed outputs of sensors 61*a* and 61*b* to capacitor C8 which charges to the peak value at this time (2*c*).

When one (or both) of the sensors 61*a* or 61*b* senses the trailing edge of a bill at $t_2$, a signal (2*b*) is applied through gates 74 and 75 to OSM76 whose $\overline{Q}$ output $\overline{\text{COMPARE}}$ (2*d*) is simultaneously applied to one input of gate 81 and input 79*a* of OSM 79.

After a predetermined time delay, determined by OSM76 and OSM79, the Q output of OSM79 at t2 is applied to the control input 91 of solid state switch SW3 (2*e*). The voltage level developed across C8 is thus applied to capacitor C17. Thereafter, the output of OSM79 triggers OSM80 whose Q output discharges capacitors C7 and C8 through transistor Q2 and solid state switch SWl at t3. When the trailing edge of the first bill is detected by sensors 61*a* and 61*b*, OSM76 is again triggered, as is the two-stage counter comprised of flip-flops 77 and 78.

When the leading edge of the next bill is detected at time $t_4$, the output of gate 74 closes switch SW2 to develop a voltage across C8 representative of the peak light intensity of the bill moving past sensors 61*a* and 61*b*. This voltage is compared against the voltage representing peak light intensity of the previous bill which was transferred to capacitor C17. The voltage levels of capacitors C17 and C8 are applied to operational amplifiers 85 and 86. The direct output from operational amplifier 85 which is applied to the non-inverting input of comparator 87, constitutes a high threshold. A portion of the output level of operational amplifier 85, controlled by adjustment of potentiometer R21, is applied as a low threshold level to the inverting input of comparator 88. A portion of the output of operational amplifier 86, controlled by the adjustment of potentiometer R22, is simultaneously applied to the inverting input of comparator 87 and the non-inverting input of comparator 88. The outputs of comparators 87 and 88 are coupled in common to terminal 94 which is coupled to the dc source +VDC through resistor R23. If the level applied to comparators 87 and 88 by operational amplifier 86 through potentiometer R22 is no greater than the high threshold and no less than the low threshold, terminal 94 remains high. However, if the level is either greater than the high threshold or less than the low threshold, terminal 94 goes low, applying a low level to input 82*a* of gate 82. Gate 82 is enabled by gate 81 after a second sheet passes sensors 61*a* and 61*b* and during a compare "window" (determined by the COMPARE output of OSM 76) by gate 81 to apply a positive going edge to D-type flip-flop 83 to generate a level at the $\overline{Q}$ output of flip-flop 83 representative of a double condition.

The passage of the trailing edge of a sheet by at least one of the sensors 61*a*, 61*b*, opens switch SW2 to again initiate a comparison operation between the values stored by capacitors C8 and C17, a subsequent transfer of the value stored by capacitor C8 to capacitor C17 and thereafter a reset operation to discharge capacitors C7 and C8 through transistor Q2 and switch SWl, respectively. Depending upon the relative voltage values stored across capacitors C8 and C17, operational amplifier 84 serves to either further charge capacitor C17 or to at least partially discharge capacitor C17 in the event that the voltage across C8 is respectively either greater than or less than the voltage across C17.

The sheet handling and counting operation continues in a normal fashion or until a doubles condition is detected, at which time the doubles output signal from flip-flop 83, causes a halt in the handling and counting operation, for example.

The motor driving the sheet handling and counting apparatus is abruptly halted using the circuitry shown in FIG. 3.

During the time that the equipment is operating normally, AND gate 96 is enabled, causing transistor Q2 coupled through gates 97, 99 to conduct, thereby coupling motor Ml to +14 volts dc. The ON signal is also applied to gate 102 which cuts off transistor Q4 through gates 106 and 108. Simultaneously therewith, transistor Q3 is rendered conductive by inverter 101 through gate 104, establishing a current path through +14 volts, Q2S (source), Q2D (drain), motor M, Q30, Q3S and ground. The level at the output of inverter 104, coupled to QlG, drives transistor Ql into cut-off.

The motor M is pulsed by driving pulses $P_2$ which close gate 96 when pulse $P_1$ is present.

During a braking condition, transistor Q2 is turned-off by removing pulses $P_2$ and the brake signal $P_3$ is applied to gate 102, causing transistors Q4 and Ql to turn on, while turning off transistor Q3, thereby establishing a current path from +14 VDC through QlS, QlD, motor M, transistor Q4D and Q4S to ground, reversing the voltage polarity across motor M. This reverse condition is maintained for a brief time interval sufficient to bring motor M substantially to a halt, after which the brake signal, which is a pulse $P_2$ of predetermined pulse width, is removed from motor M.

Motor M is also regulated in the forward feed direction to control its output speed between normal speed and one-third normal speed, through the application of pulses $P_2$ to one input of gate 96 whereby the greater number of pulses per unit time operates motor M at the normal speed and the lesser number of pulses per unit time (occurring at one-third the pulse rate) causes motor M to operate at one-third normal speed. This technique is utilized during batching wherein, as the end of a batch is approached, for example, when all but the last one or two sheets of a batch have been counted, the motor speed is reduced to one-third normal speed. Upon sensing the passing of the trailing edge of the last sheet to complete a batch, the polarity of the voltage across motor M is abruptly reversed in the manner described hereinabove. The separation distance between sheets at the one-third normal operating speed condition is approximately 2 sheet lengths measured in the feed direction, assuring that the upstream sheet is halted so that its leading edge does not reach the acceleration nip. As a result, accurate batching is assured.

As an alternative to varying the pulse rate of pulses applied to gate 96, the pulse rate may be kept constant and the pulse width of pulses $P_2$ generated may be varied. For example, pulses may be generated with their leading edges spaced apart by one millisecond intervals. The pulse width of each pulse generated may, for example, vary from one-hundred to three-hundred microseconds, to provide operation at one-third normal speed and normal speed, respectively.

FIG. 3*a* is a flow diagram of the closed-loop motor braking technique 400, which routine is entered at 402 upon the occurrence of a brake request signal. Initially two registers designated for use during the routine are cleared, one register representing the count and the second register representing the old velocity. Once these registers are set to zero, at 404, the motor is set to freewheel by removing dc power from both input terminals. At this time, the count developed by an encoder E which may, for example, be mounted to rotate on the acceleration roller shaft 26*a* (see FIG. 1) is read and is placed in a register designated for storing the old count. After a predetermined delay (408), the encoder count is again read and placed into a register which stores the new count (410). The new velocity is determined by subtracting the stored old count from the stored new count (412).

If the new count is equal to the old count (414), the routine branches (414*a*), the motor is set to be freewheeling (416) and the routine is completed (418) causing the microprocessor to return to the location in the program which called for a branch to the motor braking routine.

In the event that the new count and old count are not equal, the routine advances to step 420 through branch 414*b*. If the new velocity is not greater than the old velocity, the routine advances to step 416 through 420*a* repeating steps 416 and 418 described hereinabove.

In the event that the new velocity is greater than the old velocity, program advances to step 422 through branch 420*b* where the new velocity is transferred to the register containing the old velocity and the new count is transferred to the register ccntaining the old count. Thereafter, at 424, the polarity on the motor is reversed from what it was previously and the program then branches through 424*a* to step 408 and therafter step 410 to read the present count of the encoder after the aforementioned delay interval (408). The new velocity is again calculated (412) and the new and old counts are again examined at 414. If they are equal, the motor is set to freewheel at 416 and the subroutine is terminated at 418. If the new and old counts are not equal and the new velocity is less than the old velocity, steps 416 and 418 are again repeated. If the new velocity is greater than the old velocity, steps 422 and 424 are repeated in the same manner as was previously described.

As an alternative, motor M may be a d.c. motor used in combination with a clutch/brake. The motor is energized and when the trailing edge of a sheet is sensed by sensors $D_1$, $D_2$ (FIG. 1) the clutch/brake is energized to disengage the feed roller from the motor and halt the feed roller.

Figure 1C:
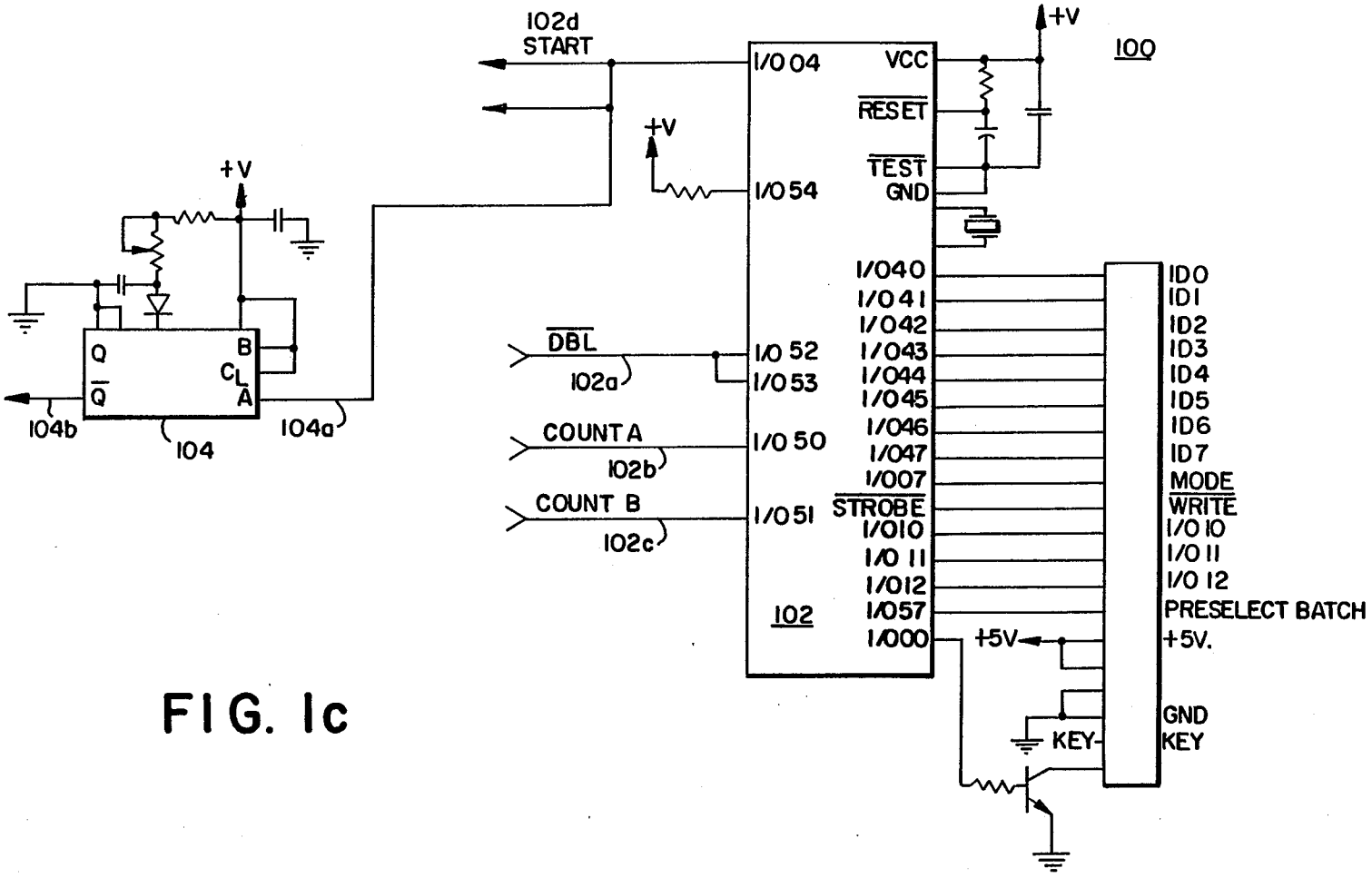

FIG. 1*c* shows the control unit 100 utilized with the circuitry of FIGS. 1*a* and 1*b* and which is comprised of a central processing unit (CPU) 102 which may, for example, be an F8 family 3870 manufactured by Mostek. However, any other CPU may be used, if desired. The doubles signal appearing at the Q output of flip-flop 83 shown in FIG. 1*b* is coupled to input 102*a* of CPU 102. Inputs 102*b* and 102*c* are respectively coupled to the outputs of operational amplifiers 64*a* and 64*b* shown in FIG. 1*a*. The start signal appearing at output 102*d* is applied to the gate 96 in the motor control circuit shown in FIG. 3 and to the invertor 89 in FIG. 1*b*, for resetting the two stage counter comprised of flip-flops 77 and 78 and for resetting flip-flop 83 which stored the doubles status. Output 102*d* is further coupled through OSM104 whose output 104*b* is coupled to gate 102 in the motor control circuit of FIG. 3.

FIG. 4 shows circuitry 110 for performing the self-adaptive length discrimination and/or doubles detection in digital fashion and is comprised of gate 112 for receiving input pulses from a shaft encoder coupled to the feed roller shaft of the document handling and counting apparatus shown in FIG. 1. Gate 112 is enabled upon receipt of an enabling signal applied to its remaining input by the output 114*a* of CPU 114. When gate 112 is enabled, pulses developed by the shaft encoder are applied to the clocking input of a multistage counter 116 whose output terminals are coupled to associated inputs of CPU 114 through inverters 118 and 120.

The outputs of operational amplifiers 64*a* and 64*b* shown in FIG. 1*a* are applied to inputs 114*b* and 114*c*, respectively of CPU 114. Input 114*d* is coupled to the output of gate 89 shown in FIG. 1*b*.

A DIP switch 116, manually settable by the operator, couples a selectively adjustable threshold level to CPU 114 for comparison with the count in counter 116.

The self-adaptive length discrimination circuitry functions in the following manner:

The shaft encoder (not shown), which may be coupled to the acceleration roller shaft, generates a predetermined number of pulses for each unit of travel. In one preferred embodiment, the shaft encoder generates 122 pulses per inch of document travel.

The operation of the system control will now be described in conjunction with the flow-diagrams shown in FIGS. 5*a* and 5*b*. When the equipment is turned-on (140) the input-output (I/O) ports are initialized (142). Thereafter, the CPU looks for a motor start at 114*d* and continues to loop at 143 and 144 until a motor start condition is detected. At 145, CPU 114 looks for a count pulse from either sensor at its inputs 114*b* and 114*c* and continues to loop between 145 and 146 until a count pulse is detected. As soon as one of the count pulses is detected, an enable condition is generated (147) and is applied to gate 112 enabling pulses from the shaft encoder to be applied to counter 116.

CPU 114 determines which sensor developed the count pulse (148, 149 and 150). Depending on which count pulse occurred first, this condition is saved (150 or 151). If both pulses occurred simultaneously this condition is saved at 152. If no count pulses are sensed, the program loops back from step 150 to 145 looking for either count pulse.

If at least one of the count pulses has been detected, the CPU looks for the end of that count pulse which first occurred and continues to loop between 153 and 154 until the end of that count pulse is detected. When the count pulse is terminated, the count in counter 116 is saved (155). The count pulse status previously saved is examined (156). If both count pulses were present simultaneously (157*a*) the second count is examined (168). If this count is zero (0), which is the case when both counts are present (169*a*) the skew count is utilized to obtain number A from the memory table.

The first count saved at 155 is withdrawn from memory (152) and the A and B values are summed (173) to obtain the value C (FIG. 10). The value C is utilized to obtain the real length from the memory table (174).

If the document just examined was the first to be examined (175*a*) the present length is saved as the previous length (176), the first document flag is reset (178) and the program loops back (180) to look for subsequent count pulses (145).

If the document just examined was not the first document (175*b*), the present length is subtracted from the previous length to determine the permissable tolerance therebetween (177). The resulting tolerance is subtracted from the DIP switch setting of DIP switch 116 (179). If the tolerance is greater than the switch setting (181*a*), the motor is halted and an error condition is displayed (183). The program loops between 183 and 184*a* until both count pulses are absent at which time the program loops back (185) to look for a motor start (143).

If the calculated tolerance is less than the DIP switch setting (181*b*) the present length is saved as the previous length and the program advances to 180 to again look for count pulses from the A and B sensors (145).

In the event that both count pulses did not occur simultaneously (157*b*), and if neither count pulse was first (158*a* and 159*a*), the program returns to the start (140).

If count two was first (158*a*), the program looks for the end of count 1 and reads the second count and saves its value (164, 165 and 166). The counter is then reset in readiness for the next document (167), the second count is retrieved from memory (168) and if non-zero (169*b*) the skew count is determined by subtracting the second count from the first count.

In a like manner, if count 1 was first (159*b*), the CPU looks for the end of count 2 and reads and saves this count (160, 161 and 162). The counter is then reset in readiness for the next document (163). The second count is then retrieved from memory (168) in the same manner as was previously described in order to calculate the document length.

Summarizing the operation, depending upon which sensor is the first to detect the leading edge, this count pulse will be monitored to terminate the first count upon termination of said first count pulse. This amount is saved as a first count. The counter continues to accumulate count pulses from the shaft encoder and when the sensor which is the last to detect the trailing edge of the skewed sheet indicates the passing of the trailing edge, the count at that time is saved. The first count is subtracted from the second count to obtain the skew count which is utilized to obtain the value A and the first count is utilized to obtain the value B and the sum of these values (C) is utilized to obtain the real length of the document. The memory is arranged as a table look-up memory where the skew count, for example, comprises the memory address and the data stored in that memory address comprises the value A corresponding to the skew count. The other look-up tables are structured in a similar fashion. The value A is the logarithm of the cosine of the skew angle $\theta$. The value B is the logarithm of the measured skewed document length ($l_A$ or $l_B$). The sum A+B=C is the logarithm of the actual length (l).

Thus, the self-adaptive length discrimination technique permits the counting of skewed sheets, enables sheet length to be determined in a self-adaptive fashion and further enables the denomination of the sheets to be determined in applications where currency is being handled and counted in countries in which different denominations have different documents lengths, document length being measured in the feed direction.

The sensing circuitry may be utilized with another software version to be described is substantially identical with the sensing circuitry shown in FIG. 1*a* and for this reason, the circuit elements which are substantially identical have been omitted for purposes of simplicity.

Figure 1D:
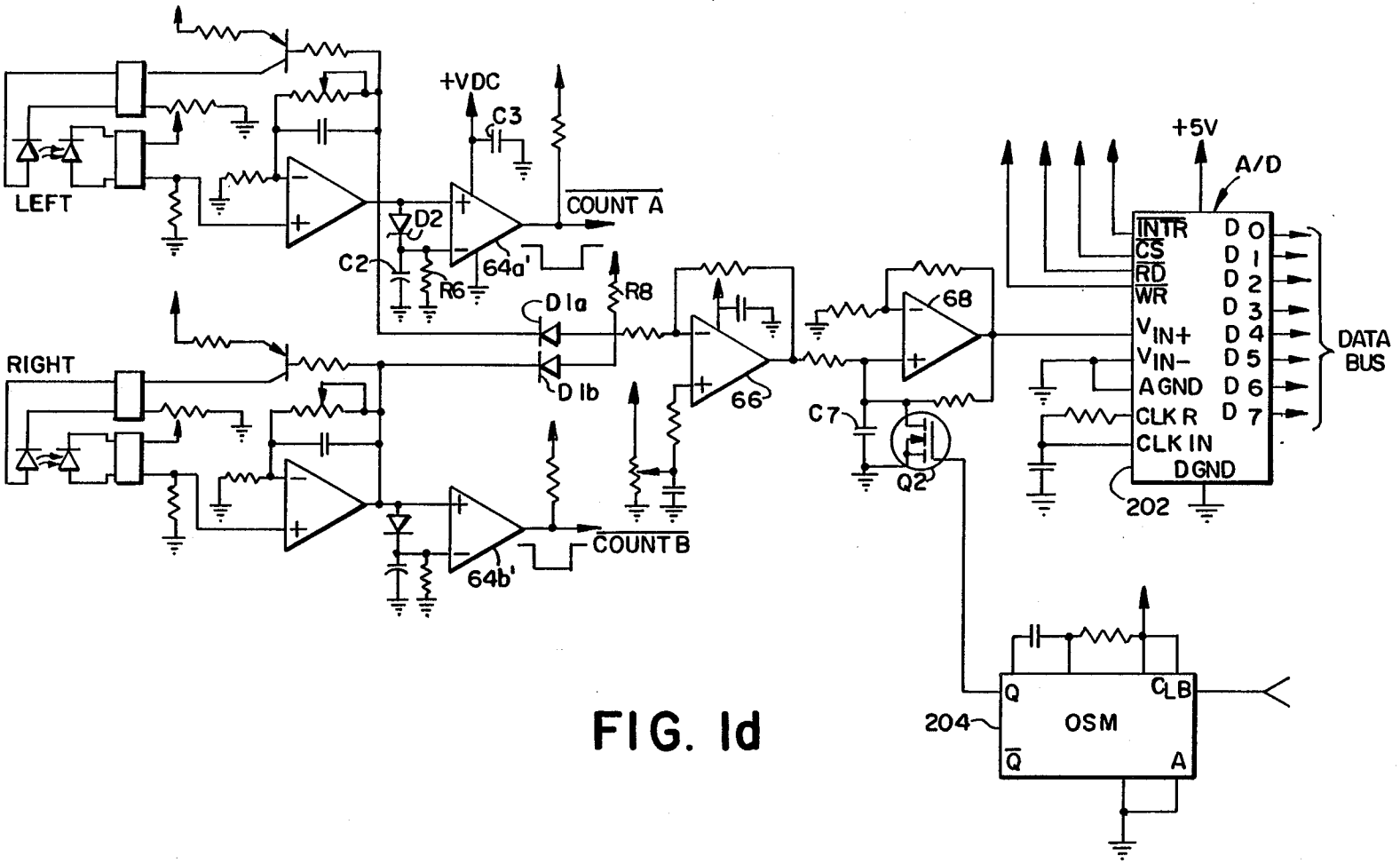

Considering FIGS. 1*c* and 1*d*, the output of operational amplifier 63*a* is coupled to the non-inverting input of operational amplifier 64*a*′ while the inverting input is coupled to ground through the parallel connected elements C2 and R6. Operational amplifier 64*a*′ differs from operational amplifier 64*a* in that it provides an inverted signal to the CPU as compared with the signal generated by operational amplifier 64*a*. Similarly, operational amplifier 64*b*′ is reversely connected to operational amplifier 63*a* in a manner to generate a waveform which is inverted as compared with the waveform generated by operational amplifier 64*b* of FIG. 1*c*.

The outputs of operational amplifiers 63*a* and 63*b* are summed by diodes D1*a* and D1*b*.

Operational amplifiers 66 and 68 are connected in the same manner as the amplifiers identified by like numbers in FIG. 1*a*.

The output of operational amplifier 68, however, is coupled to the $V_{IN+}$ of analog to digital converter 202. One-shot multivibrator 204 has its Q output coupled to the gate of transistor Q2 and has its B input coupled to receive a control input from the CPU (not shown). The digital outputs $D_0$ through $D_7$ of analog to digital (A to D) converter 202 are coupled to the data inputs of the CPU. Control signals from the CPU, including the read signal RD and write signal WR are coupled to like terminals of A to D converter 202. The CS input of A to D converter 202 receives a control signal from the CPU decoder/multiplexor circuit U2-1. Input terminal INTR of A to D converter 202 receives a control signal from the CPU.

Considering the flow diagram of FIG. 8*a*, upon the start of the adaptive average doubles routine, the bill passing the sensor is examined. If this is the first bill (212*a*) the present value (P) is retained as the reference value (R) at 214 and the program returns to the start 210. If the note is not the first note (212*b*) the present value is compared against the reference value plus a window constant. If the present value is greater than the reference value plus the window constant (216*a*) a doubles error is indicated at 222.

If the present value is less than R+K and less than R−K (216*b*) and (218*a*), a doubles indication is given (222).

If the present value is less than R+K and greater than R−K (218*b*) the present value and reference value are averaged and the average is saved as the next reference value (220).

The manner in which the signal is examined is as follows:

After the digital value from A to D converter 202 is transferred from A to D converter 202 to memory, bistable circuit 204 causes transistor Q2 to rapidly discharge capacitor C7 when either sensor senses the leading edge of the next sheet, bistable circuit 204 turns transistor Q2 off, enabling capacitor C7 to charge. In the embodiment in which the operating speed of the document handling and counting apparatus may vary with time, the integrated analog voltage signal developed across capacitor C7 is sampled at regular, predetermined intervals by controlling bistable circuit 204 in accordance with the pulses developed by the encoder coupled to the accelerator roller shaft of FIG. 1. Each digital value at the sampling time is accumulated under control of the CPU and the sum of these digital values represent the present value which is stored either as the reference value at 214 or is compared with the previously stored reference value plus the "window" at steps 216 and 218 as were described hereinabove.

FIG. 8*b* shows an alternative arrangement which may be employed in the event that it is not desired to maintain an average of the length values. Noting the flow diagram of FIG. 8*a*, wherein like steps are designated by like numerals, the only difference between the program shown in FIG. 8*a* and that shown in FIG. 8*b* resides in the fact that the last present value always becomes the next reference value thus avoiding a running average, if desired.

As an alternative arrangement for the multiple sampling of the A to D converter, in the case where the apparatus of FIG. 1 is operated at a constant speed, the integrator, instead of being sampled a plurality of times, is sampled at a predetermined constant time after the occurrence of the leading edge of a sheet and the voltage present at the end of this constant time interval is then used as a measurement of density.

In the preferred technique for constant speed operation, a calculation is made of the maximum time length required for the smallest sheet capable of being handled and the maximum anticipated transport speed. Considering an operating speed of 1500 notes per minute with the smallest note measuring 2.15 inches, in the direction of sheet feed, the time required is of the order of 12 milliseconds. Where $T=t_c \times P \times TC$ where $t_c=250$ ns and P=16 or 256; TC=188=6 CH.

Thus, in the example given, the A to D converter is sampled 12 milliseconds after detection of a leading edge.

FIGS. 9*a* and 9*b* show the flow diagrams explaining the automatic operation of the handling and counting apparatus employing the input and output tray sensors Q3*a* and Q3*b* shown in FIG. 1. Upon start-up (300) the parallel input/output circuits PI01 and PI02 and the counting and timing chip CTC are set-up (302) variables are initialized (304) and the display is zeroed (306). The CPU then looks to see if the start key has been depressed. If the start key has been depressed (318*b*) and the stacker is empty (316*a*) the count is restarted (320) the auto-stop is reset (322) and the motor is started (324). In the event that the start key has been depressed and the stacker is not empty (316*b*) the count is retained and the program advances to step 322, as described hereinabove.

In the event that a key has not been depressed at 308*b*, and the hopper is not empty (310*a*), the program continues to loop between 310*a* and 308 until a key has been pressed. When the start key is pressed, an examination is again made to determine if the start key has been depressed at 318 and the operation continues as described hereinabove.

In the event that a key has not been depressed (318*b*) and the hopper is empty (310*b*) a key depression is again looked for at 312. If a key has been depressed (312*a*) the program continues as before from step 318. If the key has not been depressed (312*b*) and the hopper is empty (314*a*) the program continues to loop between 314*a* and 312. When the key has not been depressed and the hopper is not empty the program advances to step 316 and functions in the same manner as described hereinabove.

In the case where a key has been depressed and it is not the start key (318*a*) the batch value is updated at 326 and the program loops back to step 308.

When the program reaches step 324 and the motor has been started, the program advances to step 328 to update the "A" and "B" channel status (328 and 330). These program steps constitute an examination of each sheet as shown in the flow diagram of FIG. 4 employed to examine document length.

Each sheet is examined to determine if it is complete. If the sheet is complete (332*a*) an examination is made to determine if the batch is complete. If the batch is complete (334*a*) the motor is stopped (335) and the batch message is flashed (336) to advise the operator that the batch has been completed and may be removed. The halting of the motor comprises a subroutine to be more fully described.

The stacker is examined at 338*a* to determine if it is empty and continues to loop at 338*a* until the stacker is emptied. When the stacker is empty (338*b*) the A and B channel status is reset (340), the motor is restarted (342) and the program returns to step 328.

In the event that a batch is not complete (334*b*) an examination is made to determine if there are any errors. If there are any errors (344*a*) the motor is stopped (346) an error condition is displayed (348) the A and B channel status is reset (350) and the program returns to 308 to look for key operations.

In the event that there are no errors (344*b*), the count and display are updated (352) the A and B channel status is reset (354) the auto-stop is reset (356). If a document is not complete (332*b*) or after the auto-stop has been reset (356), an examination is made to determine if the auto-stop is complete. If the auto-stop is complete (358*a*) and the start key has been depressed (360*a*) the motor is halted (362) and the program returns to step 308 to again look for key operations.

In the event that the auto-stop is not complete (358*n*) the program returns to step 328. In the event that the start key is not depressed after the auto-stop is complete (360*b*) the auto-stop is disabled (364) and program returns to step 328. The auto-stop prevents the motor from being energized for a predetermined interval sufficient to allow an operator to place an additional batch of sheets in the input tray and allows the operator sufficient time to move his or her hand from the tray before handling and counting is reinitiated. This delay may be set to any desired value.

FIGS. 6*a* through 6*c* show the flow diagram of another preferred length measurement technique. FIGS. 7*a* through 7*c* will initially be considered to provide a better understanding of the skew compensation technique and its underlying theory.

FIG. 7*a* shows a sheet S having a real length 1 in the feed direction and moving toward the sensor A and B location as shown by arrows 430, 430'.

Based upon the equations associated with FIG. 7*a*, the real length (a') is equal to the product of the apparent length (c') and the function f(b). FIG. 7*b* shows a curve relating the skew angle and the inverted value of the function f(b). For example, with the extremes given as shown in FIG. 7*b* when the skew angle is 45°, i.e. when $a=\pm b$ at this extreme condition, i.e. when the skew angle is equal to 45°, the function f(b) is equal to the square root of 2 ($\sqrt{2}$) or the actual length is equal to the apparent length divided by $\sqrt{2}$. In the event that the value b is zero, i.e. when the skew angle is 0°, the apparent length is equal to the actual length.

FIG. 7*c* shows a partial table of the values determined for the function f(b) for skew values of 1 through 18 in 1 millimeter increments, as well as the skew compensation factor when b is equal to 52 millimeters which is the same as the distance w between sensors A and B as shown in FIG. 7*a*. The compensation factors are preferably stored in successive locations in memory having addresses representative of the values b. A table look-up technique is employed wherein the value determined for the dimension b is utilized to select the appropriate compensation faction which is stored in the memory location whose address is the value b.

The length detection routine is shown in FIGS. 6*a* through 6*c*. Upon the initiation (452) of the routine (450) the A and B sensors are examined and the condition at the time of examination (454) is identified as the new status NEW STAT, which value is stored in an appropriate register in the CPU. The new status is compared against the old status (OLD STAT). If they are the same, the program branches back to step 454 through 456*a* and continues to loop until a change occurs. If the values are not equal, the program advances through branch 456*b* to determine if both old sensor values are 0 and either the A value or the B value is 1. If this condition exists, the program branches at 458*a* to 460 to set the timer equal to 0.

In the event that the condition being examined at step 458 is not present, the program advances to step 462 through branch 458*b* to determine if both A and B sensors are presently at a value 1 and either A' or B' is 0. If this condition is present, the program advances to step 464 through branch 464*a*. If A START is equal to 0, i.e. the timer is equal to 0, A' is 0 and A is 1, the encoder count is read and the count is transferred into the A START register. If the condition examined at step 464 is not present, the program branches at 464*b*. If B START and B' are both 0 and B=1, the program branches at 468*a* to read the encoder count and store the count in the B START register. If the condition being examined for is not present, the program branches at 468*b*. The program returns through jump 472—472' and advances to step 474 to transfer the sensor values which were previously in the new status register (A and B) to the old status registers (A' and B'). The program steps 456 through 470 are then repeated until the condition being examined for at step 462 is not present causing the program to branch to step 476 through 462*b*, 478 and 478'.

At step 476, if either sensor detects the passage of a trailing edge, the program advances through branch 476*a* to step 482. If neither sensor detects the passage of a trailing edge (indicating an error), the program branches at 476*b* through 480 returning to 472' (FIG. 6*a*) to 474 performs as before.

If a trailing edge has been detected, the program, at step 482 determines if this has been the A sensor and, if so, advances to 484 to read the stop count from the timer. If the A sensor has not detected a trailing edge, an examination is made at 486 to determine if the B sensor has detected a trailing edge. If so, the B stop count is read and stored in an appropriate register at 488. If the B sensor has not detected a trailing edge, the program branches at 486 to step 490. If one of the sensors is at 1, the program returns to 474 through branch 490*a*, 492 and 472. If the trailing edge of the document has yet to pass both sensors or alternatively advances through branch path 490*b* to step 494 if both trailing edges have passed the A and B sensors.

Now that the necessary measurements have been obtained, the calculations are performed at step 494 to determine the skew dimension b (See FIG. 7*a*), and the apparent length of that portion of the sheet passing beneath the A and B sensors. The program then advances to step 496 where the two apparent length values are compared. If these apparent length values are greater than a predetermined threshold, the program branches at 496*a* to step 498 where the motor is halted and an error code message is generated. Thereafter, the program advances through 502 and 502' to END step 516 to thereafter advance to the performance of the next function.

If the difference in the apparent lengths is less than the predetermined threshold, the program branches at 496*b* to advance to step 504 through 500—500'.

At step 504, document length is determined according to the formula shown at 504; the compensation factor is obtained from the look-up table and the true length is determined by equation as shown, the true length being the product of the length and the compensation factor.

At step 506, if the average length is greater than 0, the program branches at 506*a* where, at 508, an indication is given that the average length is equal to the true length and that the length calculated is a valid length. THe program then advances through 509-502' to END step 516.

If the average length is not equal to 0, the program branches at 506*b* where, at step 510, the difference between the true length and the average length is determined. If this difference is greater than a predetermined threshold, the program branches at 510*a* to 512 to halt the motor and generate an error signal. The program then advances to END step 516 through 513-502'.

If the calculated difference between true length and average length is less than the aforesaid predetermined threshold. The program branches at 510*b* to step 514 which provides a signal indicating that the calculated length is within proper limits and which calculates the average length in accordance with the formula as shown. Thereafter, the program advances to step 516 to move to the performance of the next function.

The last-mentioned method is equivalent math-wise with the first described method in that the function $F(b)=a/\sqrt{a^2+b^2}$ is equal to the cosine of the skew angle.

The major difference between the two methods is that the first described method avoids the need to perform an actual multiplication by using look-up tables of logs and anti-logs to obtain the actual length. Digital multiplication is typically a slower method than a couple of table look-ups an addition and a table look-up to obtain the final answer. The choice of method is dependent upon the microprocessor employed along with the capacity of read-only memory (ROM) available. The table look-up method tends to execute faster while requiring more ROM capacity whereas the technique performing real-time mathematical operations requires less ROM capacity but tends to execute slower. If desired, the function F(b) of the table look-up method could be calculated in real-time instead of using look-up tables, thereby reducing ROM capacity but slowing operating speed.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method for counting sheets employing apparatus including input and output locations and means for feeding sheets from said input location to said output location along a feed path arranged therebetween, first and second sensors spaced a predetermined distance apart along an imaginary line substantially perpendicular to said feed path, said method comprising the steps of:

initiating a count of pulses representing movement of said sheets as soon as the leading edge of a sheet passes at one of said sensors;

determining which of said sensors the leading edge of the sheet passes first;

saving the counts being generated at the time that the leading edge of said sheet passes both of said sensors as a first count;

saving the counts at the time the trailing edge of the sheet has passed each of said sensors;

obtaining a difference value of the counts between the leading edge and trailing edge for each sensor;

converting said first count to a skew value which is a trigonometric function related to the angle between leading edge of the sheet and said imaginary line;

converting the first count and the skew value into logarithmic form;

summing the logarithmic form of said skew value and said first count to obtain the logarithmic form of the true length of the document;

obtaining the antilog of the last mentioned logarithmic value to obtain the real length of the sheet;

comparing the real length of the present sheet with the real length of the previously examined sheet;

halting the sheet feeding assembly and displaying an error if the difference between the real length of the compared sheet is greater than a predetermined value.

2. The method of claim 1 further comprising the step of determining if the sheet just examined was the first sheet to be examined; and saving the present length of said sheet as the previous length.

3. The method of claim 1 further comprising the steps of:

determining if the last sheet examined was the first sheet to be examined;

saving the present length of the last sheet as the previous length in the event that the last sheet was not the first one to be examined and after comparison of the length of the last sheet to be examined with the previously examined sheet.

4. A method for counting sheets employing apparatus including input and output locations and means for feeding sheets from said input location to said output location along a feed path arranged therebetween, first and second sensors spaced a predetermined distance apart along an imaginary line substantially perpendicular to said feed path, said method comprising the steps of:

initiating a count of pulses representing movement of said sheets as soon as the leading edge of a sheet passes at least one of said sensors;

determining which of said sensors the leading edge of the sheet passes first;

saving the count being generated at the time that the leading edge of said sheet passes one of said sensors as a first count;

terminating said count when the trailing edge of the sheet has passed one of said sensors;

subtracting the saved value from said terminated count to obtain a difference value;

converting said first count to a skew value in accordance with a predetermined conversion factor representing the angle between leading edge of the sheet and said imaginary line;

multiplying said angle data and said first count to obtain the real length;

comparing the real length of the present document with the real length of the previously examined document;

halting the sheet feeding assembly and displaying an error if the difference between the real length of the compared sheet is greater than a predetermined value.

5. Apparatus for detecting the presence of doubles comprising:

input and output locations;

means for feeding sheets from said input location to said output location in a one-at-a-time fashion at spaced intervals and with gaps between the trailing and leading edges of adjacent sheets;

a light source and cooperating sensing means for generating an output signal representing the presence of a gap and the presence and density of a sheet;

means responsive to the change in said sensing means output signal when the leading edge of a sheet passes said sensing means for accumulating said output signal;

first and second storage means;

means responsive to the change in said sensing means output signal when the trailing edge of a sheet passes said sensing means for transferring the accumulated value to said first storage means;

said last mentioned means further including means for generating a compare enable signal of a predetermined interval;

means for transferring the contents of said first storage means to said second storage means upon termination of said compare enable signal;

means for clearing the contents of said first memory storage means upon transfer of the contents of said first storage means and said second storage means.

6. The apparatus of claim 5 further comprising means for comparing the contents of said first and second memory means responsive to the movement of at least two sheets past said sensor means and to the presence of said compare enable signal.

7. The apparatus of claim 6 wherein said comparison means further comprises means for generating a doubles signal when the difference between the values in said first and second storage means is greater than a predetermined value.

8. The apparatus of claim 7 further comprising means responsive to said compare enable signal and the movement of at least two sheets past said sensing means for storing a doubles condition when the comparison means indicates the presence of a doubles condition.

9. The apparatus of claim 5 wherein said comparison means comprises first and second comparators;

means for coupling a portion of the values stored in said first storage means to first inputs of said first and second comparators;

means for coupling the value stored in said second storage means and a portion of the value stored in said second storage means to the remaining inputs of said first and second comparator means.

10. The apparatus of claim 5 further comprising capacitor means for storing the output of said sensing means;

means for discharging said capacitor means responsive to the transfer of the contents of said first memory means to said second memory means.

11. The apparatus of claim 5 further comprising means for counting the passage of sheets, gate means responsive to the accumulation of a count of less than two to prevent sampling of said comparators and for enabling the sampling of said comparators when a count of two is reached.

12. The apparatus of claim 5 wherein said transfer means further comprises means responsive to transfer of the contents of said first storage means to said second storage means for clearing the contents of said first storage means.

13. The apparatus of claim 5 wherein said first and second storage means comprise capacitors.

14. A method for operating sensing means for sensing the changes in transmissivity of sheets detected by a pair of spaced apart sensors, the said changes being caused by the sheets moving in single file and passing said sensors including the steps of:

storing the present transmissivity values developed by the sensors in the absence of a sheet;

generating count pulses at a rate representative of sheet velocity;

accumulating the count pulses when at least one of the sensor outputs differs from the previously stored transmissivity value associated therewith;

storing a first accumulated count present when the other one of said sensors detects a change in transmissivity;

storing a second accumulated count present when said one of said sensors detects the trailing edge of the sheet;

storing a third accumulated count present when said other one of said sensors detects the trailing edge of the sheet;

obtaining the difference count between the third and first counts; and generating an alarm condition if the absolute value of the difference between the difference count and the second count is greater than a first predetermined value.

15. The method of claim 14 further comprising the steps of:

determining the true length of the sheet from the second count; and generating an alarm condition if the absolute value of the difference is greater than a second predetermined value.

16. The method of claim 14 wherein the step of determining true length further comprises the steps of providing a look-up table comprised of true length values each stored in a memory location and whose address corresponds to the difference count;

addressing the memory with the difference count to obtain the value stored at that address.

17. The method of claim 14 wherein the step of determining true length further comprises the steps of utilizing the second count as the true length when the difference count is substantially equal to zero.

18. A method for determining the presence of double fed sheets in apparatus having means for feeding sheets one at a time in spaced relationship along a feed path from an input location to an output location and first and second sensors spaced along an imaginary line perpendicular to said feed path for detecting radiation directed through said sheets from associated radiation sources comprising the steps of:

(a) storing a first signal representing the sum of the output signals of both of said sensors in a first storage device in response to the movement of the leading edge of a first sheet past said sensors;

(b) transferring said first signal to a second storage device;

(c) clearing said first storage device;

(d) storing a second signal representing the sum of the outputs of both of said sensors in said first storage device in response to the movement of the leading edge of a second sheet past said sensors;

(e) comparing said first and second signals;

(f) generating a doubles indication when the difference between the first and second signals exceeds a predetermined amount;

(g) transferring said second signal to said second storage device upon completion of said comparison step; and (h) clearing said first storage location.

19. A method as in claim 18 in which said step of transferring said second signal to said second storage device comprises averaging said first and second signals and storing said average for comparison with a third sum signal produced by a third bill.

20. A method as in claim 18 in which said steps of storing each comprises the step of summing the outputs of said sensors and applying the summed output to a storage capacitor and in which said transferring steps are performed in response to the movement past said sensors of the trailing edge of the sheet being examined.

21. Apparatus for determining the presence of double fed sheets including in combination:

means for feeding sheets one at a time in spaced relationship along a feed path from an input location to an output location, first and second radiation sensors spaced along an imaginary line perpendicular to said feeth path, respective radiation sources associated with said sensors for directing radiation through said sheets to said sensors, means for summing the output signals of said detectors, means including a first storage device responsive to movement of the leading edge of a first sheet past said sensors for storing a first summed signal, a second storage device, means for transferring said first signal to said second storage device, means for clearing said first storage device, said means including said first storage device responsive to movement of the leading edge of a second sheet past said sensors for storing a second summed signal, means for comparing said first and second summed signals and means responsive to said comparing means for generating a doubles indication when the difference between the first and second signals exceeds a predetermined amount.

22. Apparatus as in claim 21 including means responsive to said doubles indication for stopping said feeding means.

23. The apparatus of claim 21 wherein said comparison means includes first means for comparing a portion of one output signal with the other output signal and second means for comparing a portion of the other output signal with the first mentioned output signal.

24. The apparatus of claim 23 further comprising means for generating said multiple feed signal whenever the difference between signals compared by said first and second comparison means exceeds a predetermined value.

* * * * *

UNITED STATES PATENT AND TRADEMARK OFFICE

CERTIFICATE OF CORRECTION

PATENT NO. 4,761,002

DATED August 2, 1988

INVENTOR(S) : Reed et al

It is certified that error appears in the above-identified patent and that said Letters Patent are hereby corrected as shown below:

On the front page, under "[75] Inventors:"

there should be added:

--James D. Heffner, Langhorne, Pa.--

Signed and Sealed this

Twenty-ninth Day of November, 1988

*Attest:*

DONALD J. QUIGG

*Attesting Officer*

*Commissioner of Patents and Trademarks*